US009731542B2

(12) United States Patent
Le et al.

(10) Patent No.: US 9,731,542 B2
(45) Date of Patent: Aug. 15, 2017

(54) SINGLE BOOSTER BINDER MECHANISM

(71) Applicant: CCL Label, Inc., Framingham, MA (US)

(72) Inventors: L. Sean Le, Yorba Linda, CA (US); Cathleen D. Caruso, Brea, CA (US); Kenneth N. Hawley, Yorba Linda, CA (US); Eric R. Nelson, Cypress, CA (US); Eric R. Cushing, Riverside, CA (US); Jacobus M. Berkhout, Menlo Park, CA (US); Chris Whittall, Los Gatos, CA (US); Yongju Kwak, San Jose, CA (US); Daniel K. Harden, Palo Alto, CA (US); Mickey Makay, Santa Clara, CA (US); Stan Reyes, Vallejo, CA (US); Hardy S. Shen, San Jose, CA (US)

(73) Assignee: CCL Label, Inc., Framingham, MA (US)

( * ) Notice: Subject to any disclaimer, the term of this patent is extended or adjusted under 35 U.S.C. 154(b) by 0 days.

(21) Appl. No.: 15/238,819

(22) Filed: Aug. 17, 2016

(65) Prior Publication Data

US 2016/0355047 A1 Dec. 8, 2016

Related U.S. Application Data

(63) Continuation of application No. 14/506,130, filed on Oct. 3, 2014.

(Continued)

(51) Int. Cl.

*B42F 13/16* (2006.01)
*B42F 13/20* (2006.01)

(Continued)

(52) U.S. Cl.

CPC ..... *B42F 13/26* (2013.01); *B42F 13/0066* (2013.01); *B42F 13/16* (2013.01); *B42F 13/20* (2013.01); *B42F 13/22* (2013.01)

(58) Field of Classification Search

CPC ..... B42F 13/16; B42F 13/20; B42F 13/22

(Continued)

(56) References Cited

U.S. PATENT DOCUMENTS 782,986 A * 2/1905 Phoenix ..... B42F 13/26 402/42
793,370 A * 6/1905 Gresham ..... B42F 13/20 402/29

(Continued)

FOREIGN PATENT DOCUMENTS

GB 955693 4/1964

OTHER PUBLICATIONS

Patent Cooperation Treaty (PCT), International Preliminary Report on Patentability for Application PCT/US2014/059106, dated Jan. 16, 2015, International Preliminary Examining Authority, US.

*Primary Examiner* — Kyle Grabowski
(74) *Attorney, Agent, or Firm* — McDonald Hopkins LLC

(57) ABSTRACT

A binder mechanism is shown and described herein. The binder mechanism may include a base, first and second ring bases pivotally coupled to the base, first and second ring portions fixed with the ring bases, at least one pin attached with the first and second ring bases, a slide operatively engaged with the base and operatively engaged with the at least one pin, the slide selectively and axially positionable relative to the base, and an actuator operatively engaged with the slide, where the actuator is configured to selectively and axially position the slide whereby the slide positions the at least one pin to pivot the first and second ring bases away from one another to disengage the first and second ring portions.

21 Claims, 26 Drawing Sheets

Related U.S. Application Data

(60) Provisional application No. 61/886,871, filed on Oct. 4, 2013.

(51) Int. Cl.
*B42F 13/22* (2006.01)
*B42F 13/26* (2006.01)
*B42F 13/00* (2006.01)

(58) Field of Classification Search
USPC ..... 402/29–30, 36–38, 41–42
See application file for complete search history.

(56) References Cited

U.S. PATENT DOCUMENTS 798,301 A * 8/1905 Schade ..... B42F 13/16 402/41
1,439,367 A * 12/1922 Krag ..... B42F 13/26 402/41
2,075,766 A 3/1937 Rand
2,564,531 A 8/1951 Hamilton
3,205,895 A * 9/1965 Johnson ..... B42F 13/26 402/38
3,954,343 A * 5/1976 Thomsen ..... B42F 13/26 402/41
4,130,368 A * 12/1978 Jacoby ..... B42F 13/22 402/41
4,798,491 A 1/1989 Lassle
5,895,164 A 4/1999 Wu
6,036,394 A 3/2000 Cheng
6,916,134 B2 7/2005 Wong
7,331,732 B2 2/2008 Kaneda
7,404,685 B2 7/2008 Cheng
8,038,361 B2 10/2011 Cheng
9,102,187 B1 * 8/2015 Zhong ..... B42F 13/22
9,333,794 B2 5/2016 Zhong
2005/0100396 A1 5/2005 Barabas
2006/0056907 A1 3/2006 Busam
2007/0134052 A1 6/2007 Nelson et al.
2008/0075527 A1 * 3/2008 Pi ..... B42F 13/26 402/41

* cited by examiner

SINGLE BOOSTER BINDER MECHANISM

CROSS-REFERENCE TO RELATED APPLICATION

This application is a continuation of U.S. patent application Ser. No. 14/506,130 filed on Oct. 3, 2014, and entitled "Single Booster Binder Mechanism" which claims the benefit of U.S. Provisional Patent Application Ser. No. 61/886,871 filed Oct. 4, 2013, and entitled "Single Booster Binder Mechanism" which is incorporated herein by reference.

FIELD OF INVENTION

The present invention generally relates to a binder mechanism and more particularly to a single booster binder mechanism with rings.

BACKGROUND

Binders are a very common tool used by students and workers in their everyday lives. In fact, binders are likely found in almost every school and business. Binders are generally designed to hold loose documents between their covers. These documents can be easily removed and the binder can be reused for subsequent storage of other documents. Binders may have rings on the inside for securely holding the loose documents. The spine of a binder may be a solid member to which rings of latching mechanisms may be attached for the purpose of holding papers. Binders may be formed from a relatively flexible material or a relatively stiff material. The front and back covers may be interconnected to the spine through a flexible coupling allowing for easy opening and closing.

The binder mechanism is an important component of the binder. The binder mechanism operates to open and close the rings to which the loose paper may be attached. As binders are so frequently used, the key, therefore, to an effective binder is the operation of the binder mechanism. Many current prior art binder mechanisms are difficult to use. They may be difficult to open and close; they may not remain in the applicable closed or open position when required; and they may not have a long life span. Further, binder mechanisms can be difficult and expense to manufacture as there are a number of small components that require significant assembly. Further still, current binding mechanism may not control the amount the rings are opened, i.e., they are either completely opened or completely closed. Current binding mechanism can also be very noisy to operate, especially when opening and closing the rings.

Therefore, there is a need for an improved binder mechanism that may be easier to operate, is easy to open and close, and has an extended operable life span. Further, there is a need for a binder mechanism that is easier to manufacture, quicker to manufacture, and cheaper to manufacture. Further still, there is a need for a binder mechanism that may control the opening of the rings, i.e., the binder mechanism may control the amount the rings are opened. Also, there is a need for a binder mechanism that is quiet to operate.

SUMMARY

A binder mechanism is shown and described herein. The binder mechanism may include a base, a first ring base and a second ring base pivotally coupled to the base, at least one first ring portion attached to the first ring base and at least one second ring portion attached to the second ring base. At least one first pin may be attached to the first ring base and at least one second pin may be attached to the second ring base. A slide may be operatively engaged with the base and may be operatively engaged with the first and second pins, the slide may be selectively positionable relative to the base. An actuator may be coupled to the slide such that the actuator is configured to selectively position the slide whereby the slide positions the at least one first and second pins to pivot the first and second ring bases to position the first ring portions and the second ring portions to an open position and to pivot the first and second ring bases to position the first ring portions and the second ring positions to a closed position. The actuator may include a wedge slider portion.

The first ring portions of the first ring base may be generally aligned with the second ring portions of the second ring base. The base may be configured to be attached to a spine of a binder cover. The first ring base may include three first ring portions and the second ring base includes three second ring portions.

In one embodiment, the base includes a pivot retainer to operatively engage with the first ring base and the second ring base.

In another embodiment, the slide includes at least one cam profile that operatively engages with the first and second pins. The at least one cam profile extends laterally along the slide and includes a first portion and a second portion in which the first portion is angled away from the second portion laterally along the slide such that the cam profile forms a general V-shape.

In one embodiment, the binder mechanism further comprises a housing that generally encases the base, the first ring base, the second ring base, the at least one first pin, the at least one second pin, and the slide.

Also disclosed by this application is a binder that may include a binder cover having a spine and a binder mechanism attached to the spine. The binder mechanism may include a base, a first ring base and a second ring base pivotally coupled to the base. At least one first ring portion is attached to the first ring base and at least one second ring portion attached to the second ring base. At least one first pin is attached to the first ring base and at least one second pin is attached to the second ring base. A slide may be operatively engaged with the base and operatively engaged with the first and second pins, the slide may be selectively positionable relative to the base. An actuator may be coupled to the slide such that the actuator is configured to selectively position the slide whereby the slide positions the at least one first and second pins to pivot the first and second ring bases to position the first ring portions and the second ring portions to an open position and to pivot the first and second ring bases to position the first ring portions and the second ring positions to a closed position.

The first ring portions of the first ring base may be generally aligned with the second ring portions of the second ring base. The second ring base may include substantially the same configuration as the first ring base. The main base may include a pivot retainer to operatively engage with the first ring base and the second ring base. The slide may include at least one cam profile that operatively engages with the first and second pins. The at least one cam profile may extend laterally along the slide and include a first portion and a second portion in which the first portion is angled away from the second portion laterally along the slide such that the cam profile forms a general V-shape.

The binder mechanism may include a housing that generally encases the at least one base, the first ring base, the second ring base, the at least one first pin, the at least one second pin, and the slide. The binder mechanism may be attached to the spine by at least one rivet.

Also disclosed is a binder mechanism for a binder, the binder mechanism may include a first ring base and a second ring base pivotal with respect to one another. At least one first ring portion may be attached to the first ring base and at least one second ring portion may be attached to the second ring base. A slide may be operatively engaged with the first and second ring bases, the slide is selectively positionable relative to first ring base and the second ring base. An actuator may be coupled to the slide such that the actuator is configured to selectively position the slide whereby the slide allows pivoting of the first and second ring bases to position the first ring portions and the second ring portions to an open position and allows pivoting of the first and second ring bases to position the first ring portions and the second ring positions to a closed position.

In one embodiment, the binder further includes at least one pin operatively coupled to the first ring base and the second ring base to pivot the first ring base relative to the second ring base. The slide may position the at least one pin to pivot the first and second ring bases to position the first ring portions and the second ring portions to the open position and to pivot the first and second ring bases to position the first ring portions and the second ring positions to the closed position. The binder mechanism may include at least one cam profile that is defined by the first and second ring bases to operatively engage with the at least one pin. A biasing member may be coupled to the slide to provide a bias force.

In one embodiment, an actuator mechanism having an actuator pin and a pin path may be operatively engaged with the slide, the actuator pin may be moveable relative to a pin path of the slide between opened and closed positions, wherein a user may displace the slide with the bias force of the biasing member and move the actuator pin along the pin path to pivot the ring portions in the open position, and wherein the user may displace the slide against the bias force of the biasing member and move the actuator pin along the pin path to pivot the ring portions in the closed position.

Another embodiment of a binder mechanism is disclosed herein. The binder mechanism may include a housing, a first ring base and a second ring base pivotally positioned within the housing. At least one first ring portion may be attached to the first ring base and at least one second ring portion may be attached to the second ring base. A slide may be positioned within the housing and operatively engaged with the first and second ring bases, the slide may be selectively positionable relative to first ring base and the second ring base. An actuator may be operatively engaged with the slide such that the actuator is configured to selectively position the slide whereby the slide pivots the first and second ring bases to position the first ring portion and the second ring portion to an open position and pivots the first and second ring bases to position the first ring portion and the second ring position to a closed position.

In one embodiment, the actuator may include a button that is linearly displaceable with respect to the housing to selectively position the slide. The button may be spaced from the housing when the first ring portion and the second ring portion are in the open position. The button may be adjacent the housing when the first and second ring portions are in the closed position.

In embodiments of the present disclosure, a binder mechanism may include a housing with first and second ring bases positioned within the housing. A first ring portion may be attached to the first ring base and a second ring portion may be attached to the second ring base. A slide may be positioned within the housing and operatively engaged with the first and second ring bases. An actuator may be positioned adjacent the housing and operatively engaged with the slide whereby the actuator selectively positions the slide to pivot the first and second ring bases with respect to each other.

The first and second ring bases may move the first ring portion and the second ring portion to an open position. In one embodiment, the pivoting of the first and second ring bases may move the first ring portion and the second ring portion to a closed position. The slide may be selectively positionable relative to the first ring base and the second ring base. The actuator may include a button positioned linearly adjacent to the housing, the actuator may include a button positioned away from the housing, or the actuator may include a button positioned to a side of the housing.

The actuator may be selectively pushable to position the slide to pivot the first and second ring bases with respect to each other. The actuator may include a button whereby pushing the button toward the housing positions the slide to pivot the first and second ring bases with respect to each other. The actuator may include a button whereby pushing the button toward the housing positions the slide to pivot the first and second ring bases to an open position. The button may be pushed toward the housing to position the slide to pivot the first and second ring bases to a closed position. The button may be spaced from the housing when the first and second ring bases are in the open position. The button may be immediately adjacent the housing when the first and second ring bases are in the closed position. The button may be in contact with the housing when the first and second ring bases are in the closed position.

In embodiments of the present disclosure, a binder mechanism may include a housing and a first ring base and a second ring base positioned within the housing. At least one first ring portion may be attached to the first ring base and at least one second ring portion may be attached to the second ring base. A slide may be operatively engaged with the first and second ring bases. The slide may be selectively positionable relative to first ring base and the second ring base. An actuator may be operatively engaged with the slide such that the actuator is configured to selectively position the slide whereby the slide allows the first and second ring bases to pivot to position the first ring portion and the second ring portion to an open position and allows the first and second ring bases to pivot to position the first ring portion and the second ring portion to a closed position.

BRIEF DESCRIPTION OF THE DRAWINGS

Operation of the invention may be better understood by reference to the following detailed description taken in connection with the following illustrations, wherein.

DETAILED DESCRIPTION

Figure 1:
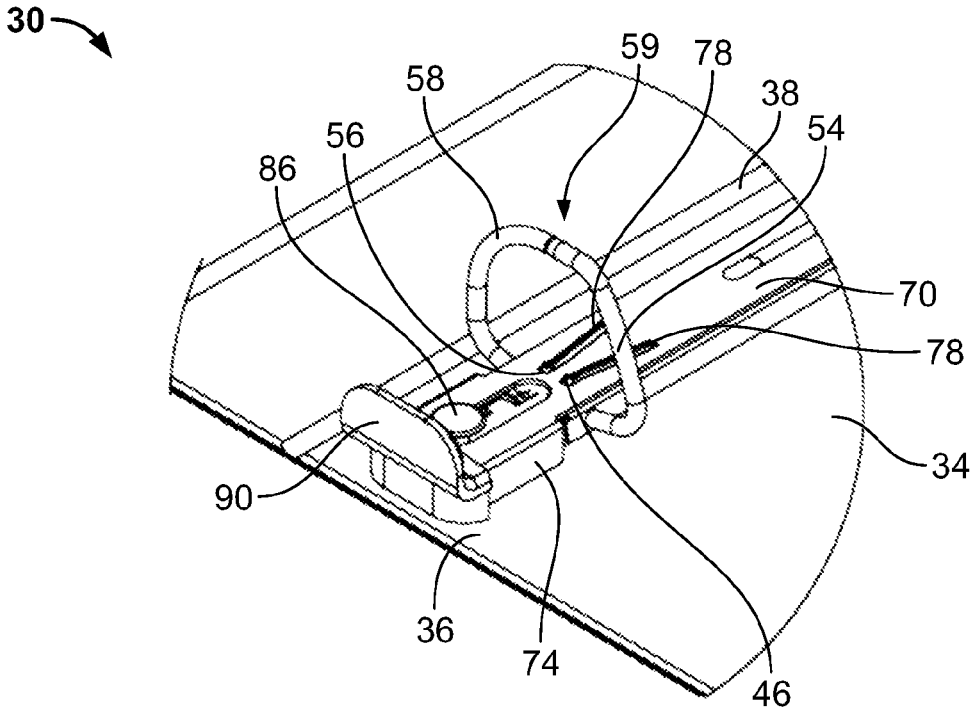
FIG. 1 is a perspective of an embodiment of a binder mechanism in a closed position.
Figure 2:
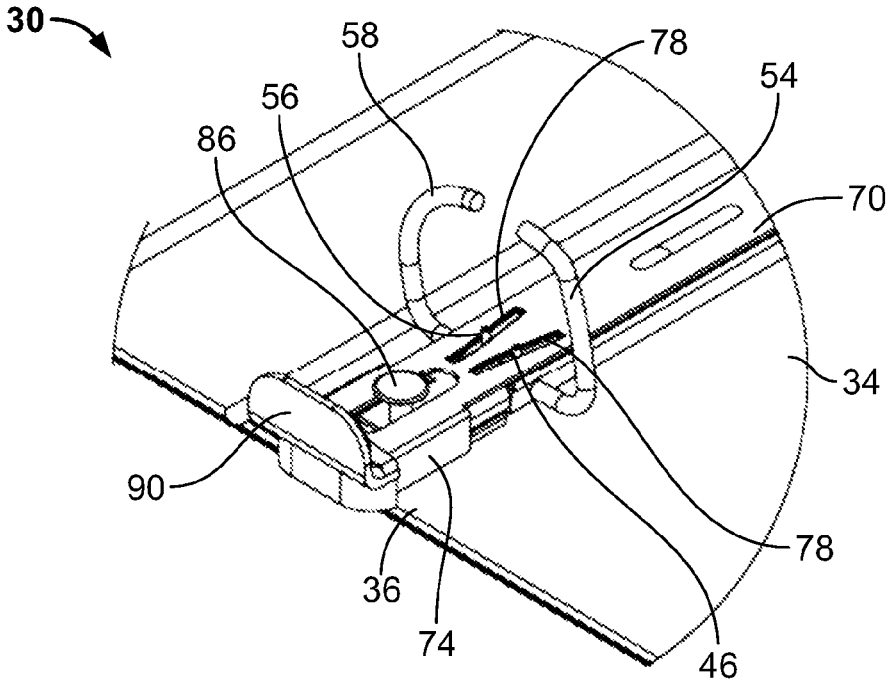
FIG. 2 is a perspective of an embodiment of a binder mechanism in a partial position.
Figure 3:
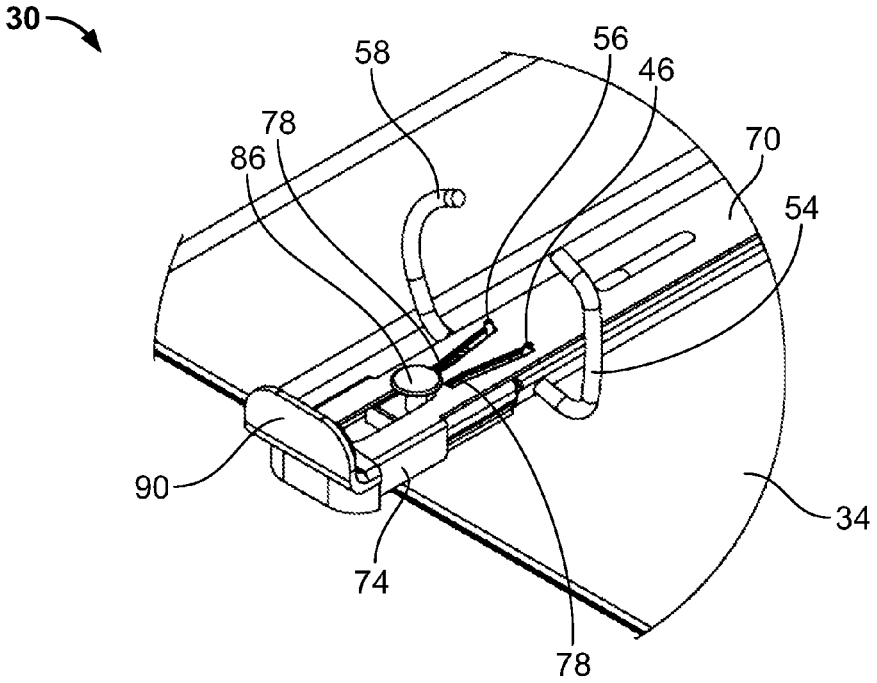
FIG. 3 is a perspective of an embodiment of a binder mechanism in an open position.
Figure 4:
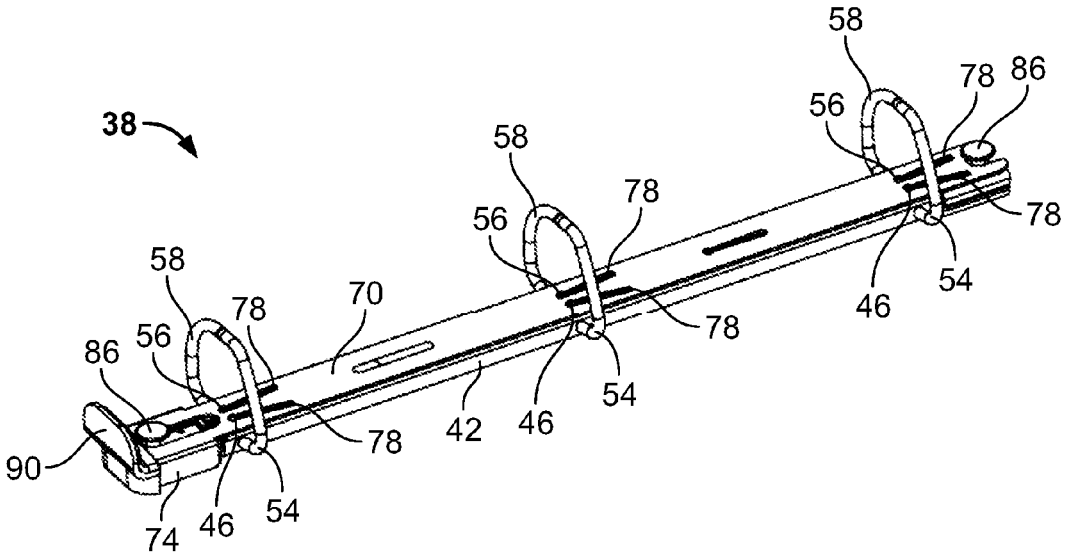
FIG. 4 is a perspective of an embodiment of a binder mechanism in a closed position.
Figure 5:
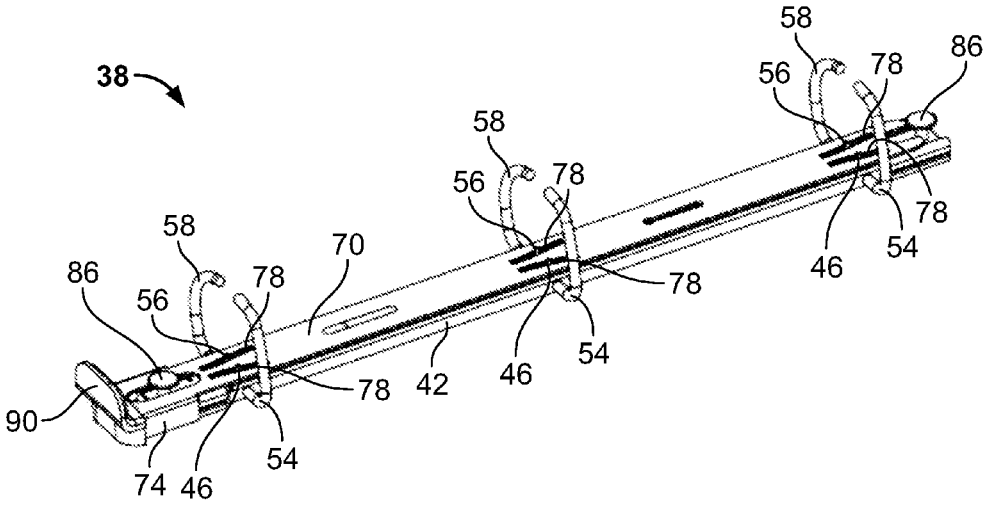
FIG. 5 is a perspective of an embodiment of a binder mechanism in a partial position.
Figure 6:
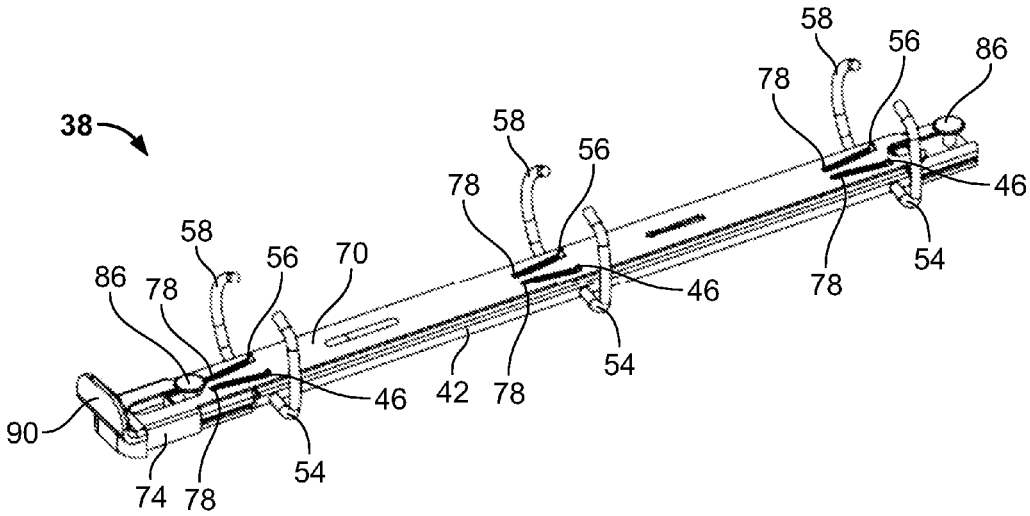
FIG. 6 is a perspective of an embodiment of a binder mechanism in an open position.
Figure 7:
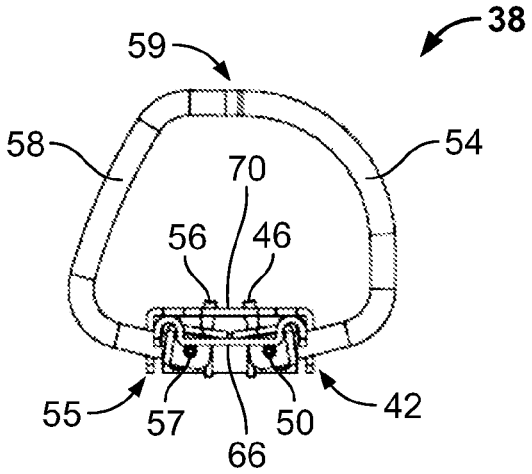
FIG. 7 is a side view of an embodiment of a binder mechanism in a closed position.
Figure 8:
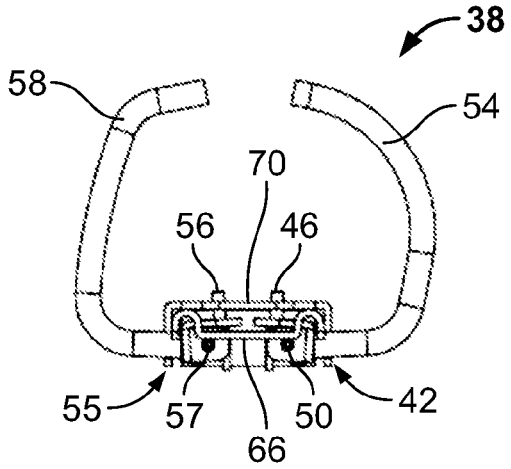
FIG. 8 is a side view of an embodiment of a binder mechanism in a partial position.
Figure 9:
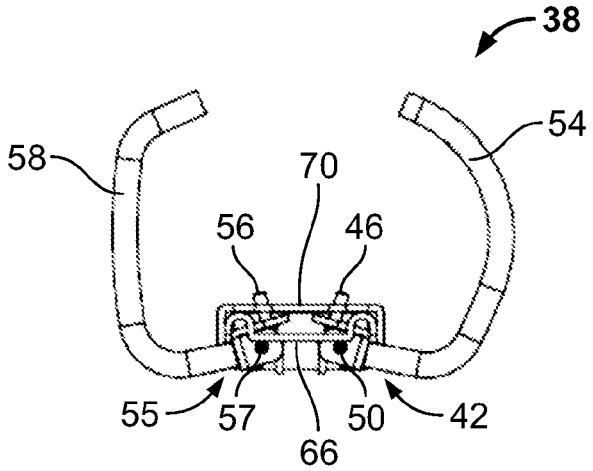
FIG. 9 is a side view of an embodiment of a binder mechanism in an open position.
Figure 10:
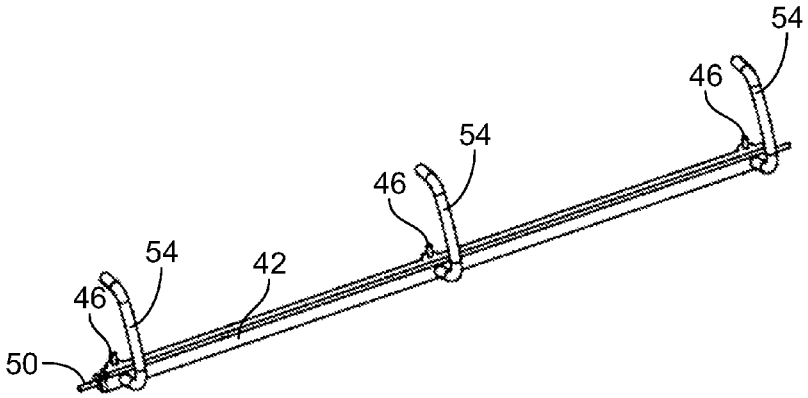
FIG. 10 is a partial perspective view of a binder mechanism.

Reference will now be made in detail to exemplary embodiments of the present invention, examples of which are illustrated in the accompanying drawings. It is to be understood that other embodiments may be utilized and structural and functional changes may be made without departing from the respective scope of the invention. Moreover, features of the various embodiments may be combined or altered without departing from the scope of the invention. As such, the following description is presented by way of illustration only and should not limit in any way the various alternatives and modifications that may be made to the illustrated embodiments and still be within the spirit and scope of the invention.

A binder 30 is shown and described in FIGS. 1-11. The binder 30 may be of any appropriate configuration and is not limited to that shown and described herein. It should similarly be understood that the binder 30 may be of any appropriate size, including, without limitation, 8.5 inches by 11 inches, A4 size, legal size or any other applicable size. The binder 30 may include a binder cover 34 of any appropriate size and construction. The binder cover 34 may be made of any appropriate material, including, without limitation having a polypropylene cover with a stiffener inserted within the cover. As way of a further exemplary embodiment, the binder cover 34 may also be formed from a monolithic plastic piece. The binder cover 34 may include pockets or any other apparatus therein to hold items (such as writing instruments, rulers, paper clips, etc.) or paper. It should be understood that the binder cover 34 may be of any appropriate construction and is not limited to that shown and described herein.

The binder cover 34 may include a spine 36. The spine 36 may be of a similar construction as the binder cover 34, e.g., a polypropylene cover with a stiffener inserted within the cover and/or monolithically formed with the binder cover 34 such as a single piece of plastic. Alternatively, the binder cover 34 may have a different construction to that of the binder cover 34—the present teachings are not limited to the embodiments shown and described herein. Any appropriate configuration and construction may be used without departing from the present teachings.

The binder 30 may include a binder mechanism 38 that may be attached with the spine 36 in any appropriate manner. By way of a non-limiting example, the binder mechanism 38 may be fastened, adhered, welded or otherwise attached with the spine 36. By way of a further non-limiting example and as shown in FIGS. 1-6 and 11, the binder mechanism 38 may include at least one rivet 86 that may be coupled with the spine 36 securing the binder mechanism 38 with the binder cover 34 forming the binder 30. It should be understood, however, that the present teachings are not limited to this, but that any appropriate manner of securing the binder mechanism 38 with the binder cover 34 may be utilized without departing from the present teachings.

Figure 11:
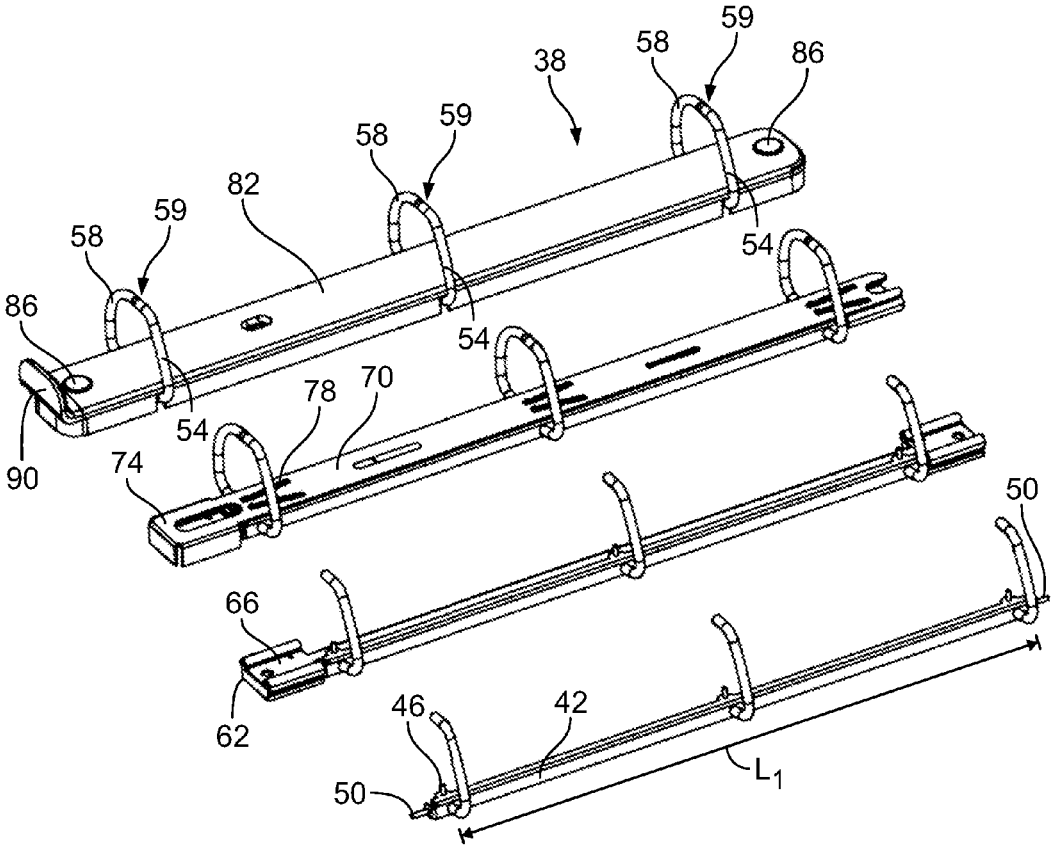
FIG. 11 is an exploded view of a binder mechanism.

As shown in detail in FIG. 11, the binder mechanism 38 may include a first ring base 42. The ring base 42 may be of any appropriate configuration. By way of a non-limiting example, the ring base 42 may be of a length $L_1$ that is generally the same or slightly less than a length $L_2$ of the spine 36 (See FIG. 29). The ring base 42, however, may be of any appropriate length. The ring base 42 may be formed from any appropriate material, including, without limitation from metal, plastics or the like.

The first ring base 42 may include at least one wedge pin 46 attached thereto. As shown in the drawings, the first ring base 42 may include three wedge pins 46. It should be understood, however, that any appropriate number of wedge pins 46 may be used without departing from the present teachings. The wedge pins 46 may be attached with the ring base 42 in any appropriate manner, including, without limitation via welding, adhering, fastening or by being monolithically formed therewith. The wedge pins 46 may be attached at any appropriate location. By way of a non-limiting example, the wedge pins 46 may be attached at generally equidistance along the ring base 42—see for example, FIG. 11.

At least one pivot pin 50 may be included within the binder mechanism 38. In one embodiment, the at least one pivot pin 50 may extend from the first ring base 42. By way of a non-limiting example, ring base 42 may include a pair of pivot pins 50 attached thereto at end portions thereof. The pivot pins 50 may be of any appropriate configuration and may be attached with the ring base 42 in any appropriate manner. By way of a non-limiting example, the pivot pins 50 may be welded, adhered, fastened or monolithically formed with the ring base 42. Alternatively, the at least one pivot pin 50 may extend from another member of the binder mechanism 38 or may be jettisoned from various embodiments.

The ring base 42 may further include at least one ring portion 54. As shown, the ring base 42 may include three ring portions 54. The ring portions 54 may be attached with the ring base 42 in any appropriate manner. By way of a non-limiting example, the ring portions 54 may be attached by welding, adhering, fastening or monolithically forming them with the ring base 42. The ring portions 54 may be positioned along with ring base 42 at any appropriate location. As shown in FIG. 11, the ring portions 54 may be positioned generally equidistance along with ring base 42 and may be positioned generally adjacent to the wedge pins 46. The present teaching, however, are not limited to this configuration. In some embodiments, the ring portions 54 may be offset from the wedge pins 46, may be positioned in a skewed manner along with ring base 42 or may be positioned both offset and skewed.

The binder mechanism 38 may include a pair of ring bases. In one embodiment, a second ring base 55 may be provided that may be a mirror image of the first ring base 42. However, the first ring base 42 and the second ring base may also include differing configurations. In such embodiments, a second ring base 55 may include a second set of wedge pins 56 and a second set of pivot pins 57. The second ring base 55 may have substantially the same configuration as ring base 42. The second set of wedge pins 56 may have substantially the same configuration as the wedge pins 46 and the second set of pivot pins 57 may have substantially the same configuration as the pivot pins 50. The second ring base 55 may include a second set of ring portions 58. The second set of ring portions 58 may be substantially a mirror image of the ring portions 54, or may possess a different configuration thereto.

The ring portions 54 and 58 may when operatively engaged to one another may form a binder ring 59. The binder ring 59 may be of any appropriate configuration. In some embodiments, the shape of the binder ring 59, i.e., the engaged ring portions 54 and 58, may be or may not be generally symmetrical. In such embodiments, therefore, the ring portions 54 may have a different configuration than the ring portions 58. It should be understood, however, that the present teachings are not limited to a specific ring configuration. Any appropriate configuration of rings may be used without departing from the present teachings.

The binder mechanism 38 may include a main base 62 operatively coupled with the first ring base 42 and the second ring base 55—see FIG. 11. The binder mechanism 38 may include a pair of main bases 62 as shown. The main bases 62 may be coupled with the ring base 42 at end portions thereof. The main bases 62 may be coupled thereto in any appropriate manner. Further, the main bases 62 may be coupled with the second ring base 55 as well. The main base 62 may secure the ring base 42 in an operative position relative to the second ring base 55 and adjacent thereto.

A pivot retainer 66 may be operatively coupled with the main base 62 in any appropriate manner. In those embodiments that include a pair of main bases 62, each main base 62 may have operatively secured thereto a pivot retainer 66. Further, the pivot retainer 66 may operatively engage with the pivot pins 50 and 57. The pivot retainer 66 may permit the ring bases 42 and 55 to pivot, which in turns allows the ring portions 54 and 58 to operatively pivot as will be described in more detail below. Alternatively, in one embodiment, the first ring base 42 and the second ring base 55 do not include pivot pins 50 and 57, respectively and are permitted to operatively pivot within the binder mechanism 38 without the main base 62 or pivot retainer 66.

A slide 70 may be operatively attached with the ring bases 42 and 55 in any appropriate manner. The slide 70 may be of any appropriate configuration and may be formed of any appropriate material, including, without limitation, plastic, metal or the like. The slide 70 may include a wedge slide portion 74. The wedge slide portion 74 may be operatively engaged with at least one of the main bases 62. As shown in FIG. 11, the wedge slide portion 74 may be operatively engaged with one of the main bases 62 at an end of the ring bases 42 and 55. The wedge slider portion 74 may be selectively positionable relative to the main base 62. The slide 70 may be selectively positionable relative to ring bases 42 and 55. As shown in FIG. 11, the slide 70 may be axially or linearly positionable relative to the long axis of the ring bases 42 and 55.

The slide 70 may include at least one cam profile 78. As shown in FIG. 11, the slide 70 may include at least six cam profiles 78. The cam profiles 78 may be positioned at any appropriate location on the slide 70. As shown, the wedge pins 46 and 56 may operatively engage the cam profiles 78. By way of a non-limiting example, there may be as many cam profiles 78 as there are wedge pins 46 and 56—however, the present teachings are not limited to this configuration. The cam profiles 78 may be of any appropriate configuration. By way of a non-limiting example, a pair of the cam profiles 78 may be juxtaposed one another and may extend generally laterally along the slide 70. The cam profiles 78 may include a first portion and a second portion. The first portion may be angled away from the second portion such that as they extend laterally along the slide they become further apart from one another and form a generally V-shape. Alternatively, the cam profiles 78 may be defined within the first ring base 42 and second ring base 55 and the wedge pins 46, 56 may extend from the slide 70. In these embodiments, the position of the slide 70 may operatively pivot the first ring base 42 and second ring base 55 as the wedge pins 46, 56 are guided within the cam profiles 78 defined by the ring bases 42, 55. The first ring base 42 may be generally aligned with the second ring base 55 in the closed position and be generally pivoted relative to one another in the open position. In these embodiments, the wedge pins 46, 56 may extend through the cam profiles 78 of the first and second ring bases 42, 55 in the closed position and be generally retracted from the cam profiles 78 in the open position.

The binder mechanism 38 may include a housing 82 that may generally encase the entire assembly. The housing 82 may be of any appropriate configuration and may be made of any appropriate material, including, without limitation, metal, plastics or the like. The housing 82 may provide an aesthetically pleasing finish to the binder mechanism 38. The housing 82 also may generally protect the working components from the environment, including, without limitation protecting the operation of the ring portions 54 and 58. The housing 82 may be attached with the main base 62 in any appropriate manner. By way of a non-limiting example, a rivet 86 may attach the housing 82 with the main base 62—and as shown a pair of rivets 86 may be utilized. It should be understood, however, that any appropriate number of rivets 86 may be utilized without departing from the present teachings. In some embodiments, the rivets 86 may attach the housing 82 to the binder mechanism 38 and onto the binder 30 and allow the slider 70 to slide relative to the housing 82. This may allow the first and second ring bases 42, 55 to operatively pivot within the housing 82.

The binder mechanism 38 may also include an actuator 90 that may be used to operate the binder mechanism 38, such as to open or close the ring portions 54, 58. The actuator 90 may be operatively engaged with the slide 70, such as by way of a non-limiting example, with the wedge slider portion 74. The actuator 90 may be attached in any appropriate manner, including, without limitation via fastening, welding or adhering. The actuator 90 may be configured such that it may be selectively positioned to operate the binder mechanism 38. As shown in FIG. 11, the actuator 90 may include a pull lever 90 that may be attached with the wedge slider portion 74.

In operation, the user may selectively position the actuator 90, such as linearly pulling the lever 90 away from the binder 30. This selective positioning of the actuator 90 may selectively position the wedge slider portion 74, such as linearly pulling the wedge slider portion 74 away from the binder 30. In some embodiments, as the wedge slider portion 74 is moved, the wedge pins 46 and 56 may be forced apart from one another. Specifically, the wedge pins 46 and 56 may travel along with cam profile 78. As the adjacent cam profiles 78 move away from one another as they laterally extend along the slide 70, the wedge pins 46 and 56 may follow the respective cam profiles 78 and move away from one another. This may cause the ring bases 42 and 55 to pivot at the pivot pins 50 and 57—the ring bases 42 and 55 may pivot away from one another. As the ring bases 42 and 55 pivot away from one another, the ring portions 54 and 58 will pivot away from one another. This may, therefore, result in the ring portions 54 and 58 separating from one another opening the binder mechanism 38 such that paper and the like may be added or inserted into the binder mechanism 38.

In order to close ring portions 54 and 58 into engagement with one another, the user may move the wedge slider portion 74—such as by grasping and linearly moving the actuator 90—in a direction opposite to the direction above. The wedge pins 46 and 56 may move along the cam profiles 78 and moved toward one another. As the wedge pins 46 and 56 are moved together, the ring bases 42 and 55 may pivot toward one another closing them. This may result in the ring portions 54 and 58 moving toward one another until the ring portions 54 and 58 engage forming the binder ring 59.

In some embodiments, in operation, the user may selectively position the actuator 90 to place the binder mechanism 38 in the open or closed position. The actuator 90 may selectively position the slider 70 by linearly pushing the slider 70 and the wedge pins 46 and 56 extending therefrom towards and away from the binder 30. The wedge pins 46 and 56 may engage through the cam profiles 78 of the first and second ring bases 42, 55, respectively in the closed position and retract from the cam profiles 78 of the first and second ring bases 42, 55 to tilt the ring portions 54, 58 in the open position. In each position, the actuator 90 may be locked in place until the user selectively positions the actuator 90 to modify the position of the ring portions 54, 58.

Additional embodiments of a binder mechanism according the present teachings are described below. In the descriptions, all of the details and components may not be fully described or shown. Rather, some of the features or components are described and, in some instances, differences with the above-described embodiments may be pointed out. Moreover, it should be appreciated that these other embodiments may include elements or components utilized in the above-described embodiments although not shown or described. Thus, the descriptions of these other embodiments are merely exemplary and not all-inclusive nor exclusive. Moreover, it should be appreciated that the features, components, elements and functionalities of the various embodiments may be combined or altered to achieve a desired binder mechanism without departing from the spirit and scope of the present teachings.

A binder mechanism 138 is shown in FIGS. 12-25 and 43-50. The binder mechanism 138 may be operatively attached with a binder cover 34, or more specifically, with the spine 36 thereof, in any appropriate manner. The binder mechanism 138 may be of any appropriate configuration. The binder mechanism 138 may include a base 142 of any appropriate configuration and construction. The base 142 may be formed of any appropriate material, including, without limitation plastic, metal or the like.

First and second ring base 146 and 156 may be operatively secured with the base 142 in any appropriate manner. By way of a non-limiting example, the first and second ring base 146 and 156 may be pivotally coupled with the base 142. The ring bases 146 and 156 may include first and second ring portions 154 and 158. The first and second ring portions 154 and 158 may be attached with the ring bases 146 and 156 in any appropriate manner, including, without limitation via welding, fastening, adhering or being monolithically formed therewith. Any appropriate number of ring portions 154 and 158 may be included, such as three. It should be understood, however, that the present teachings are not limited to the three ring portions 154 and 158 shown. Further, the ring portions 154 and 158 when engaged together may form binder rings 159. As shown, three binder rings 159 may be utilized.

First and second wedge pins 160 and 162 may be attached with the ring bases 146 and 156 in any appropriate manner—such as by fastening, welding, adhering or forming monolithically therewith. The wedge pins 160 and 162 may be positioned in any operative position, such as adjacent to the ring portions 154 and 158.

The binder mechanism 138 may further include a slide 164. The slide 164 may be operatively attached with or otherwise operatively engaged with either or both of the ring bases 146 and 156 and/or the base 142. The slide 164 may be attached in any appropriate manner, such as using rivets 196 or may otherwise be positioned within a housing 192 (as described in more detail below). The slide 164 may be formed of any appropriate material, including, without limitation plastic, metal or the like. The slide 164 may include a wedge slider 168. The wedge slider 168 may be monolithically formed with the slide 164 and may be positioned at an end thereof. Alternatively, the wedge slider 184 may be attached with the slide 164 through a separate operation, such as by way of a non-limiting example, adhering, welding, fastening or the like. The wedge slider 168 may be of any appropriate configuration.

Figure 44:
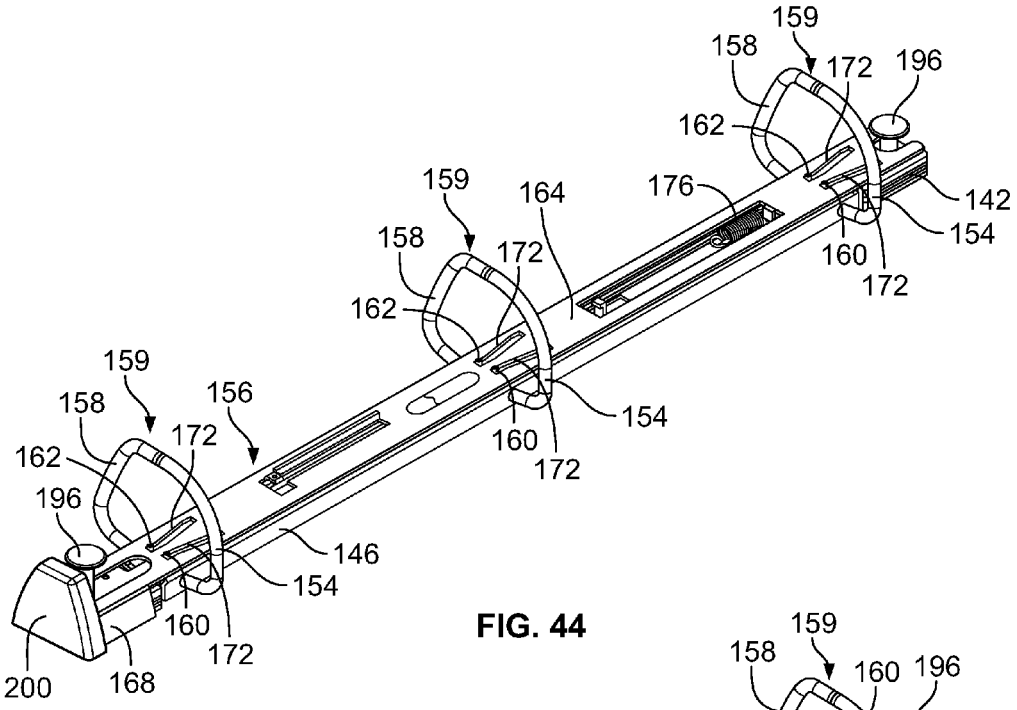
FIG. 44 is a perspective view of a portion of a binder mechanism of FIG. 43.
Figure 45:
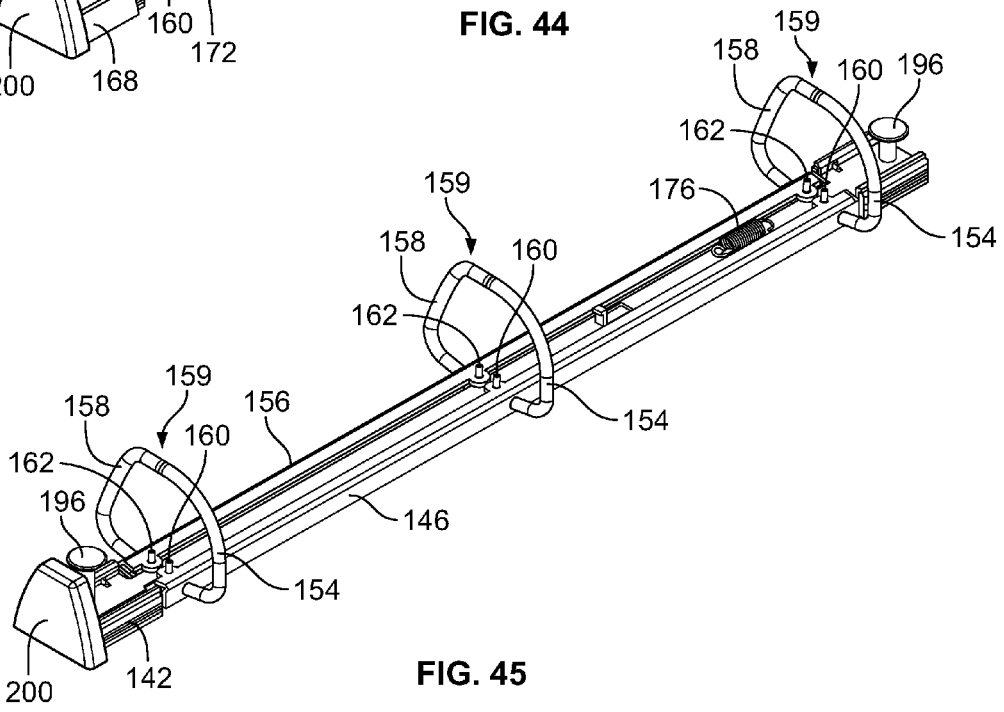
FIG. 45 is a perspective view of a portion of a binder mechanism of FIG. 43.
Figure 46:
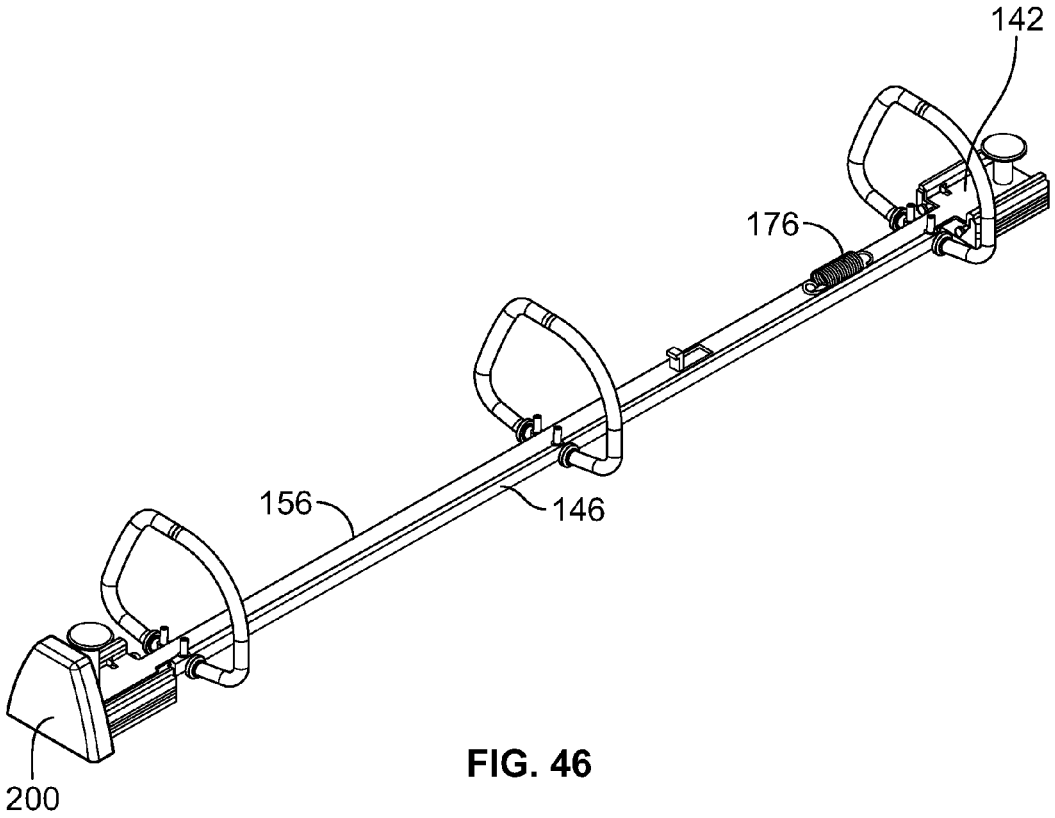
FIG. 46 is a perspective view of a portion of a binder mechanism of FIG. 43.
Figure 47:
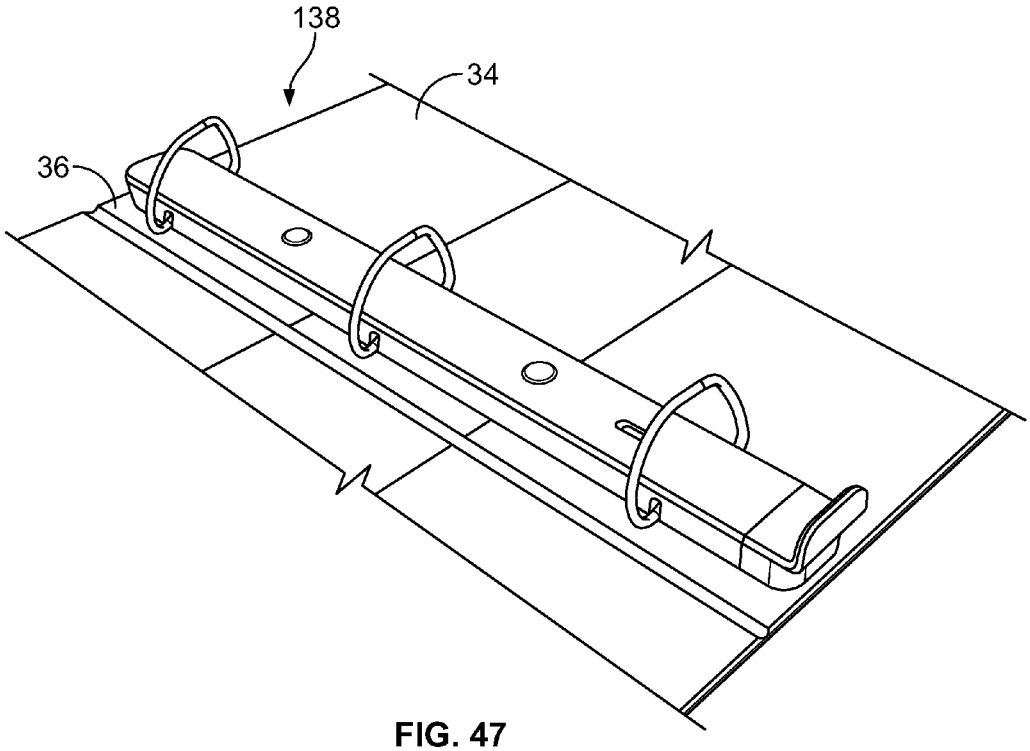
FIG. 47 is a perspective view of an embodiment of a binder mechanism coupled with a binder in a closed position.
Figure 48:
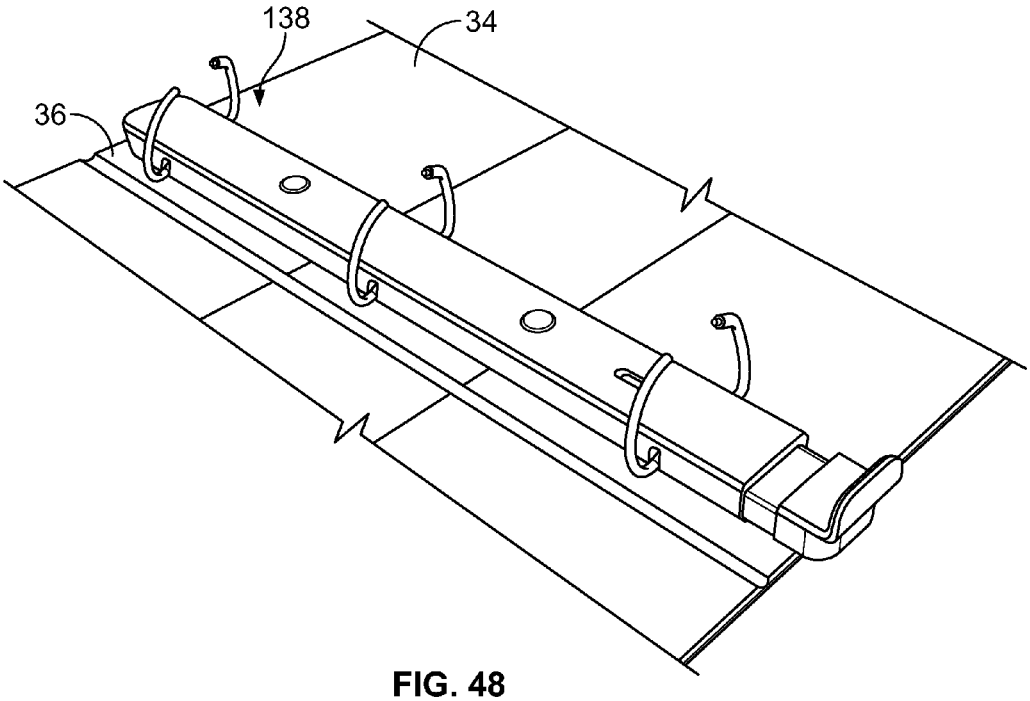
FIG. 48 is a perspective view of the binder mechanism coupled with the binder of FIG. 48 in an opened position.
Figure 49:
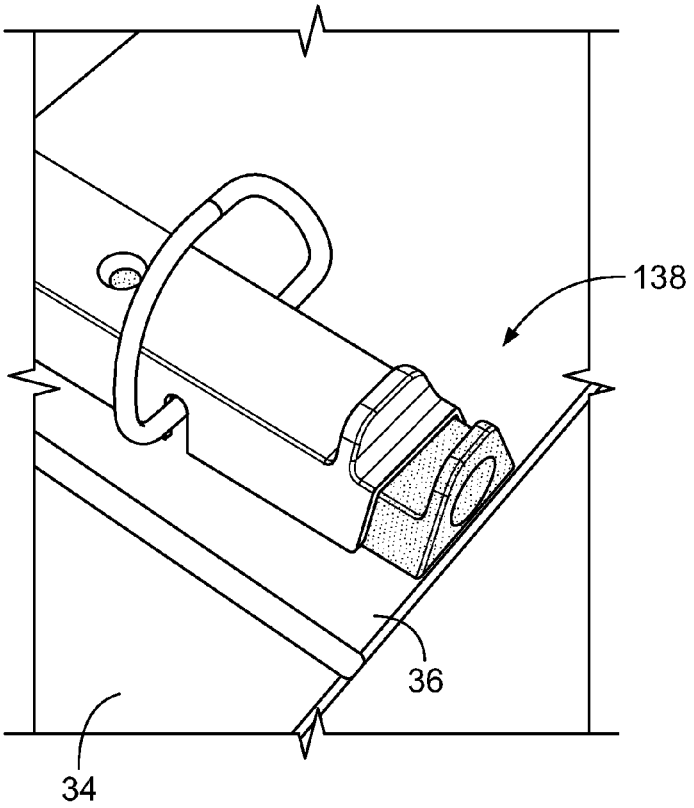
FIG. 49 is a perspective view of an embodiment of a binder mechanism coupled with a binder in a closed position.
Figure 50:
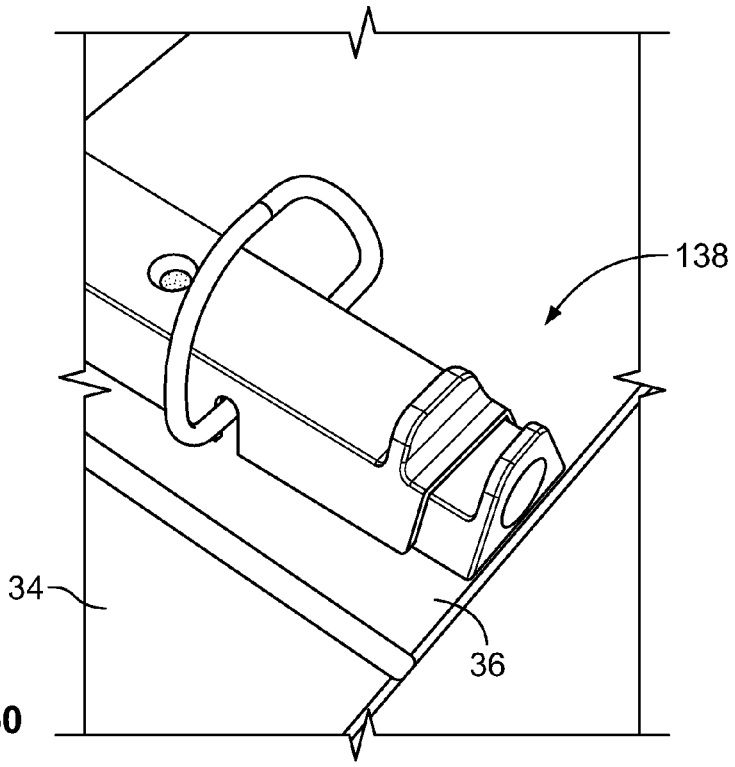
FIG. 50 is a perspective view of an embodiment of a binder mechanism coupled with a binder in a closed position.

The slide 164 may include at least one cam profile 172. As shown in FIG. 44, the slide 164 may include at least six cam profiles 172. The cam profiles 172 may be positioned at any appropriate location on the slide 164. As shown, the wedge pins 146 and 156 may operatively engage the cam profiles 172. By way of a non-limiting example, there may be as many cam profiles 172 as there are wedge pins 146 and 156—however, the present teachings are not limited to this configuration. The number of cam profiles 172 may be different from the number of wedge pins 146 and 156. The cam profiles 172 may be of any appropriate configuration. By way of a non-limiting example, a pair of the cam profiles 172 may be juxtaposed one another and may extend generally laterally. The cam profiles 172 may be angled away from one another such that as they extend laterally they become further apart from one another—such that they form almost a general V-shape.

The binder mechanism 138 may include a biasing member 176. The biasing member 176 may be operatively engaged with the base 142 and the slide 164. The biasing member 176 may be of any appropriate configuration, including, without limitation being a coil spring as shown in the accompanying drawings. The biasing member 176 may bias the slide 164 relative to the base 142. In some embodiments, the biasing member 176 may bias the slide 164 such that the binder mechanism 138 is biased toward a closed position. While a single biasing member 176 is shown and described, any number of biasing members may be used.

The binder mechanism 138 may include actuator mechanism 180, may include only the mechanism illustrated by FIGS. 43-46, or both. The actuator mechanism 180 may include an actuator pin 184 located on a slide at any appropriate location. The actuator pin 184 may be made of any appropriate material, including, without limitation, metal, plastics or the like. The actuator pin 184 may be attached with a slide in any appropriate manner—such as fastening, welding, adhering or forming monolithically together. The actuator pin 184 may be of any appropriate size and shape.

The actuator mechanism 180 may further include a pin path 188 positioned on a housing 192. By way of a non-limiting example, the pin path 188 may be positioned on an underside of the housing—see FIG. 44. The pin path 188 may be engraved or otherwise formed on the underside of the housing 192. The actuator pin 184 may operatively engage the pin path 188 as described in more detail below. The pin path 188 may be of any appropriate configuration and is not limited to that shown and described.

The binder mechanism 138 may further include a housing 192 that may generally encase the components set forth above of the binder mechanism 138. The housing 192 may be of any appropriate configuration and may be formed of any appropriate material, including, without limitation of metal, plastics or the like. The housing 192 may generally protect the components set forth above from environmental conditions. Further, the housing 192 may provide an aesthetically pleasing finish to the binder mechanism 138. As such, the housing 192 may be of any appropriate configuration and may contain any aesthetic finishes.

The housing 192 may be attached with the base 142, slide 164 or both in any appropriate manner. As shown, rivets 196 may attach the housing 192 with either or both of the base 142 and slide 164. The rivets 196 may be of any appropriate configuration and may be formed of any appropriate material, including, without limitation, metal, plastics or the like.

The binder mechanism 138 may also include an actuator 200 that may be used to operate the binder mechanism 138, such as to open or close the ring portions 154, 158. The actuator 200 may be operatively engaged with the slide 164, such as by way of a non-limiting example, the wedge slider portion 168. The actuator 200 may be attached in any appropriate manner, including, without limitation via fastening, welding or adhering. The actuator 200 may be configured such that it may be selectively positioned to operate the binder mechanism 138. As shown in FIGS. 12-20, the actuator 200 may include push button 200 that may be attached with the wedge slider portion 168. This may result in the push button 200 being operatively connected with the slide 164 and may operatively position the actuator pin 184 within the pin path 188, or may operatively position the pin path 188 relative to the actuator pin 184.

Figure 12:
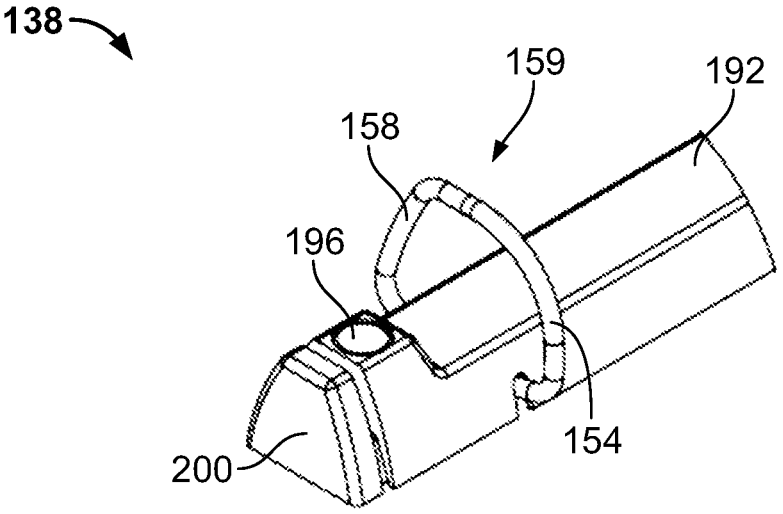
FIG. 12 is a partial perspective view of an embodiment of a binder mechanism in a closed position.
Figure 13:
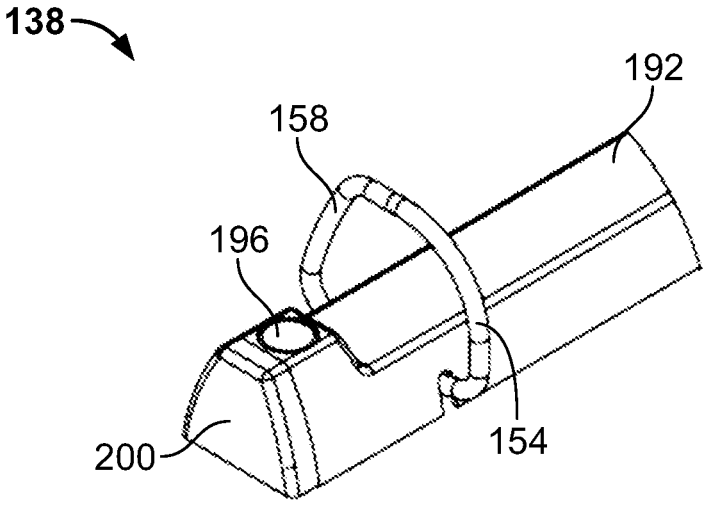
FIG. 13 is a partial perspective view of an embodiment of a binder mechanism in a pushed-in position.
Figure 14:
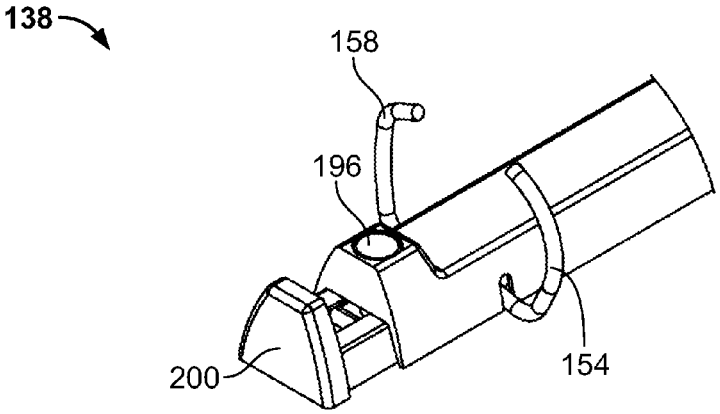
FIG. 14 is a partial perspective view of an embodiment of a binder mechanism in an open position.
Figure 15:
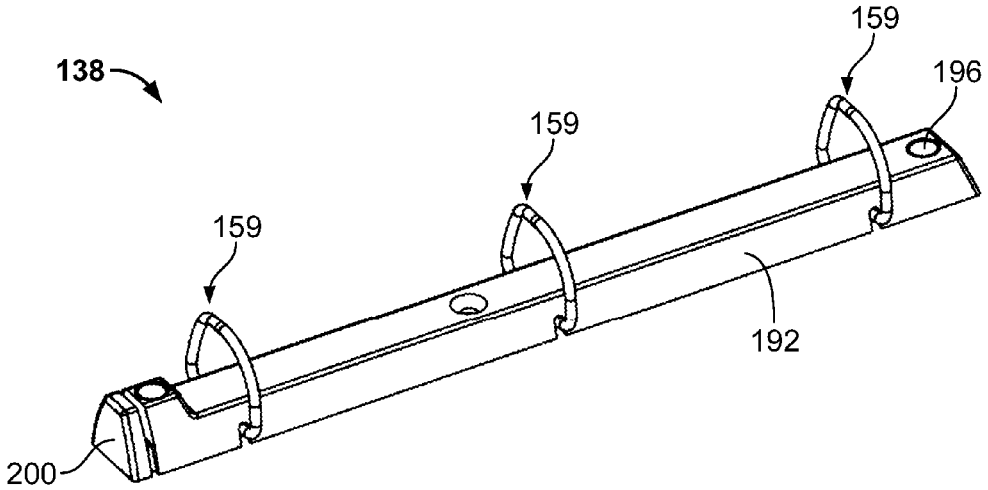
FIG. 15 is a perspective view of an embodiment of a binder mechanism in a closed position.
Figure 16:
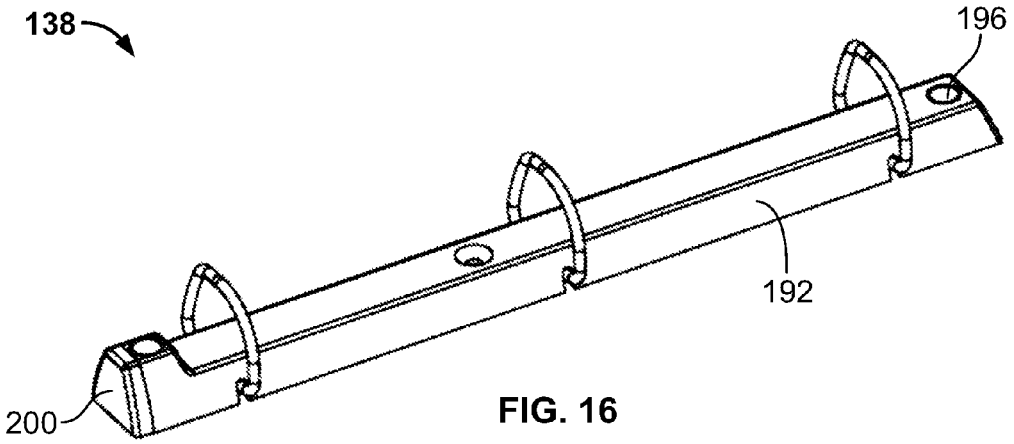
FIG. 16 is a perspective view of an embodiment of a binder mechanism in a pushed-in position.
Figure 17:
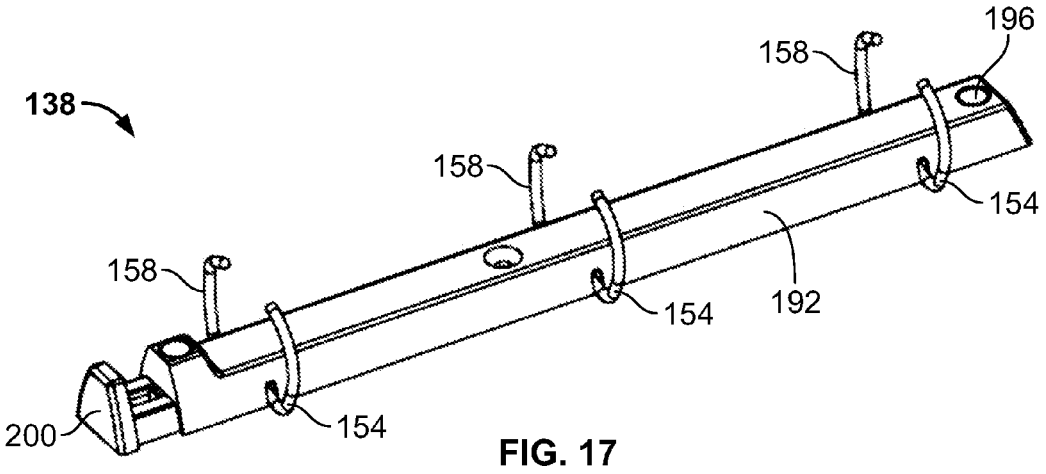
FIG. 17 is a perspective view of an embodiment of a binder mechanism in an open position.
Figure 18:
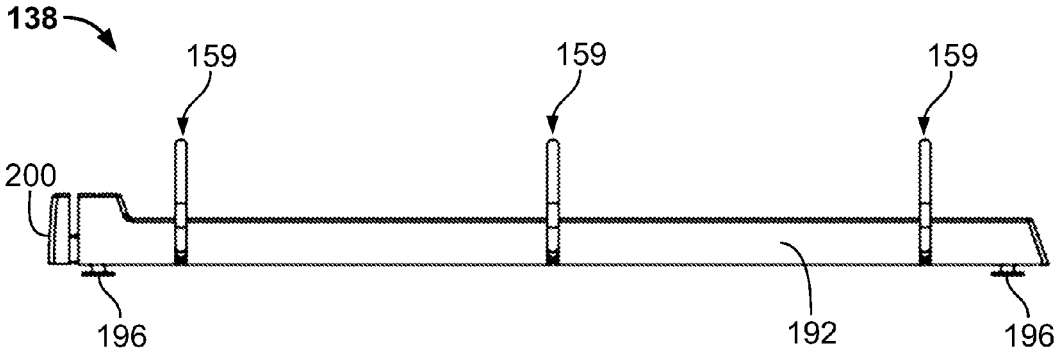
FIG. 18 is a side view of an embodiment of a binder mechanism in a closed position.
Figure 19:
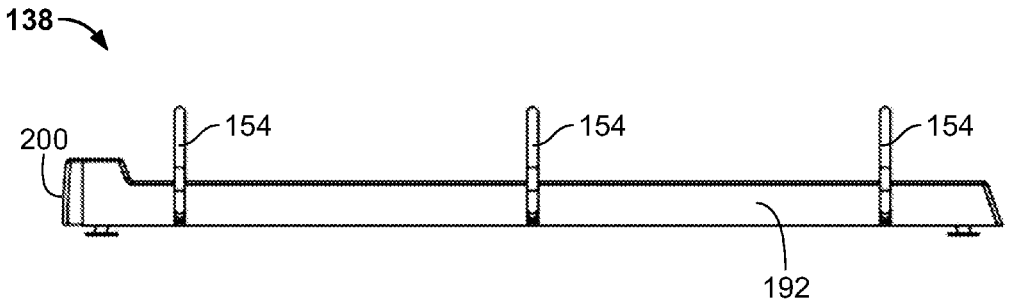
FIG. 19 is a side view of an embodiment of a binder mechanism in a pushed-in position.
Figure 20:
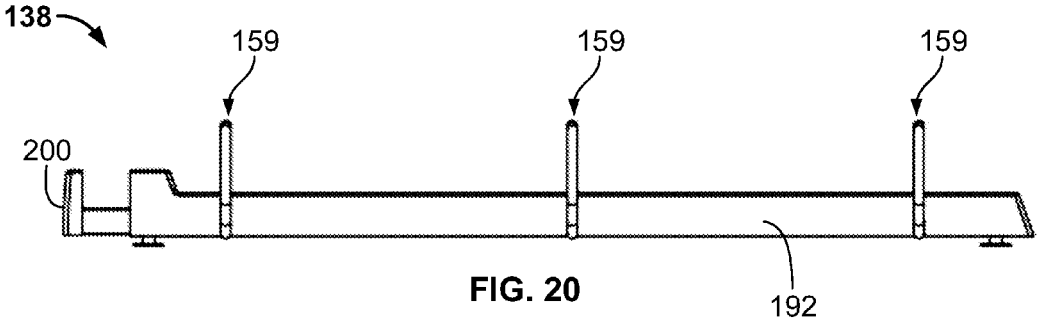
FIG. 20 is a side view of an embodiment of a binder mechanism in an open position.
Figure 21:
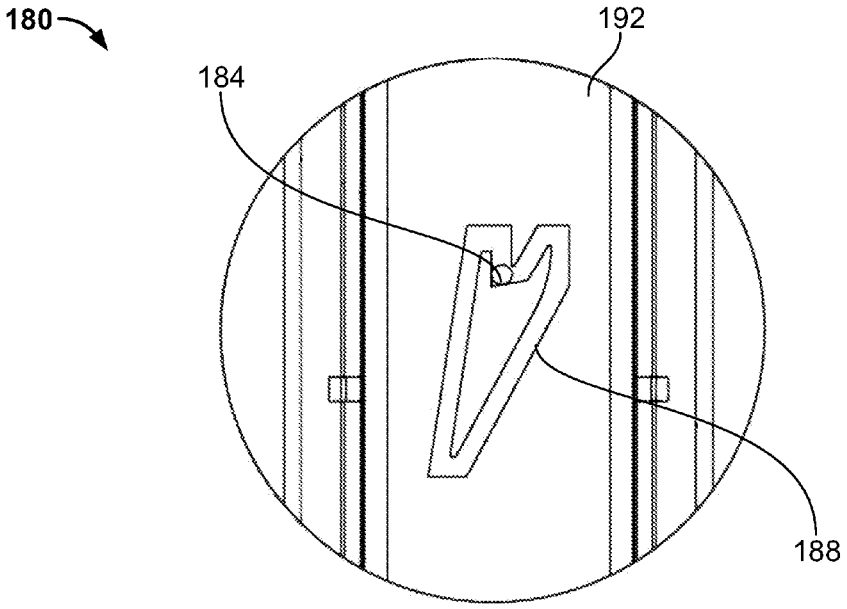
FIG. 21 is a partial scaled view of an actuator mechanism of the binder mechanism of FIGS. 12-20 in a closed position.
Figure 22:
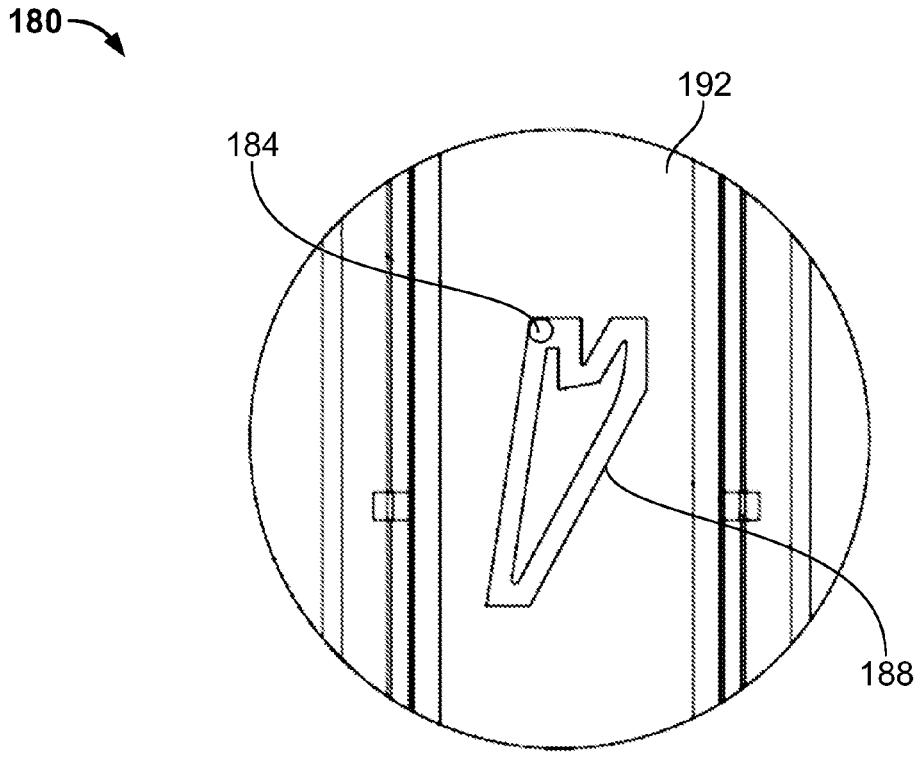
FIG. 22 is a partial scaled view of an actuator mechanism of the binder mechanism of FIGS. 12-20 in a pushed-in position after closed position.
Figure 23:
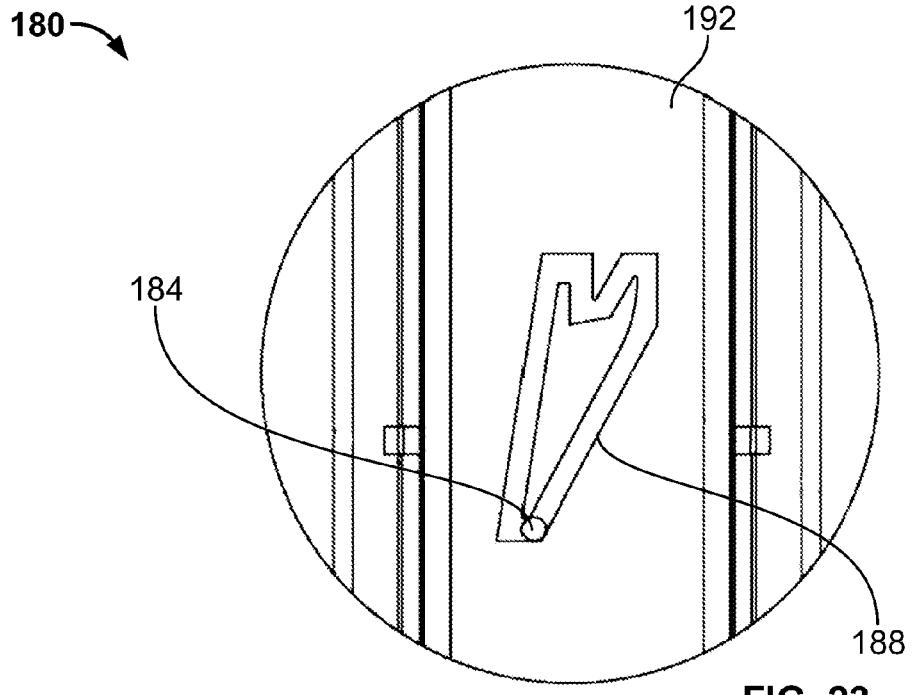
FIG. 23 is a partial scaled view of an actuator mechanism of the binder mechanism of FIGS. 12-20 in an open position.
Figure 24:
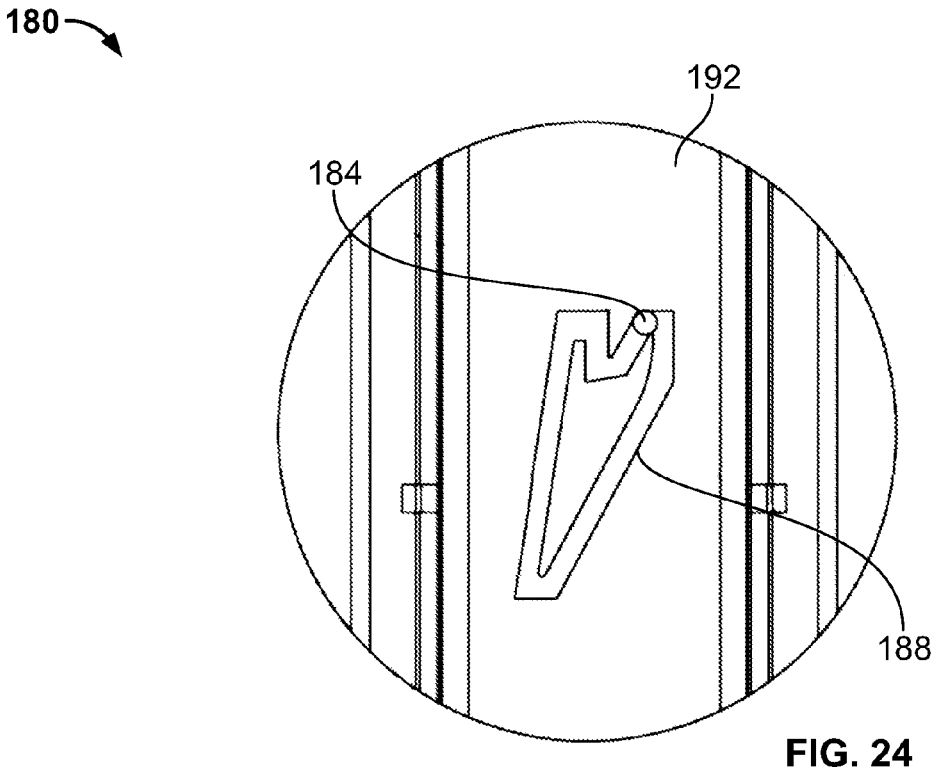
FIG. 24 is a partial scaled view of an actuator mechanism of the binder mechanism of FIGS. 12-20 in a pushed-in position after open position.
Figure 25:
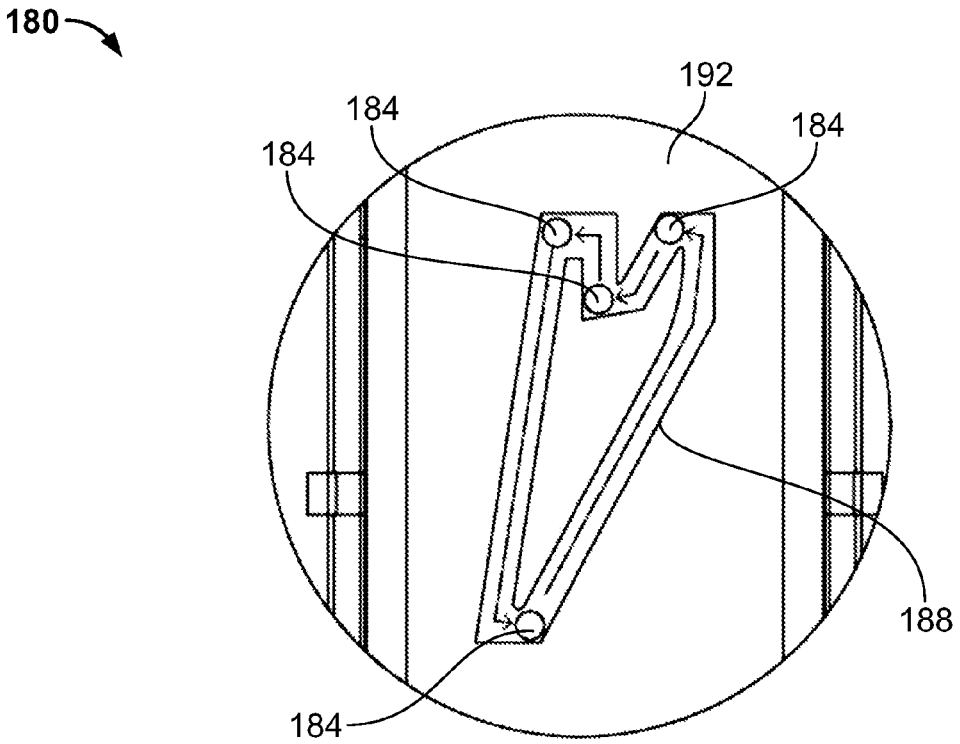
FIG. 25 is a partial scaled view of an actuator mechanism of the binder mechanism of FIGS. 12-20 identifying the operative positions thereof.

In operation, the actuator 200—such as the push button 200—may be laterally displaced in a direction toward the binder mechanism 138. As the push button 200 is laterally displaced to the pushed-in position as shown in FIGS. 13, 16 and 19, the actuator mechanism 180 may move to the unlocked position. The biasing member 176 may bias the push button 200 outward and the ring portions 154 and 158 may pivot away from one another to an unlocked or open position, such as shown in FIGS. 14, 17 and 20. To close the binder mechanism 138, the user may laterally displace the push button 200 toward the pushed-in position shown in FIGS. 13, 16 and 19. The push button 200 may then be released to the closed position as shown in FIGS. 12, 15 and 18. In the closed position, the ring portions 154 and 158 may pivot toward one another until engagement, which may form the rings 159.

In such embodiments, the first and second ring bases 146 and 156 may pivot toward one another toward a closed position whereby the ring portions 154 and 158 engage one another. The first and second ring bases 146 and 156 may pivot away from one another. This pivoting may cause the ring portions 154 and 158 to pivot away from one another, which may open the rings 159 such that a user may insert the appropriate items therein.

Figure 26:
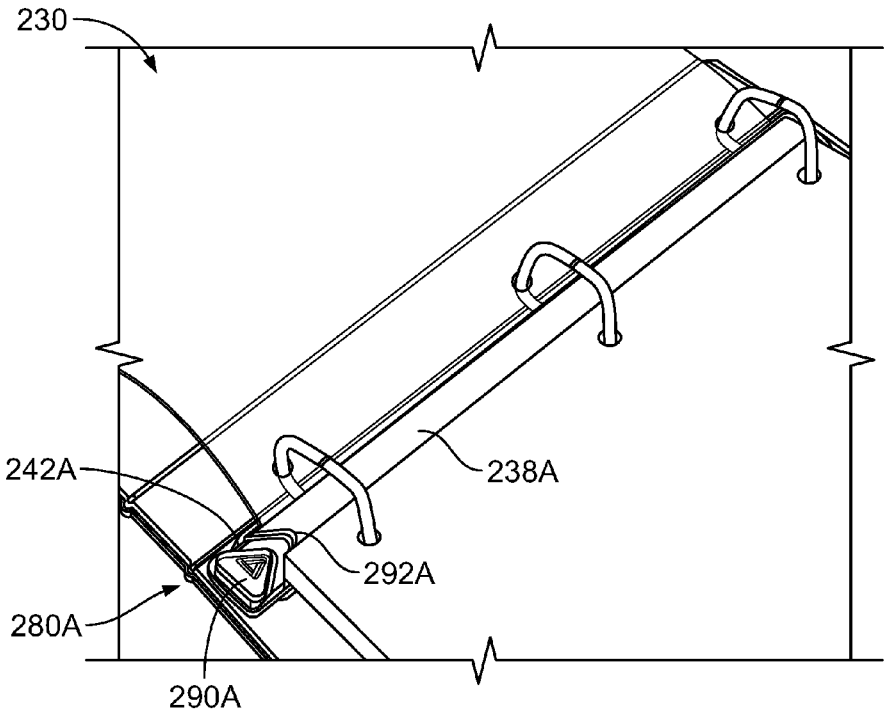
FIG. 26 is a perspective view of an embodiment of a binder mechanism coupled with a binder.
Figure 27:
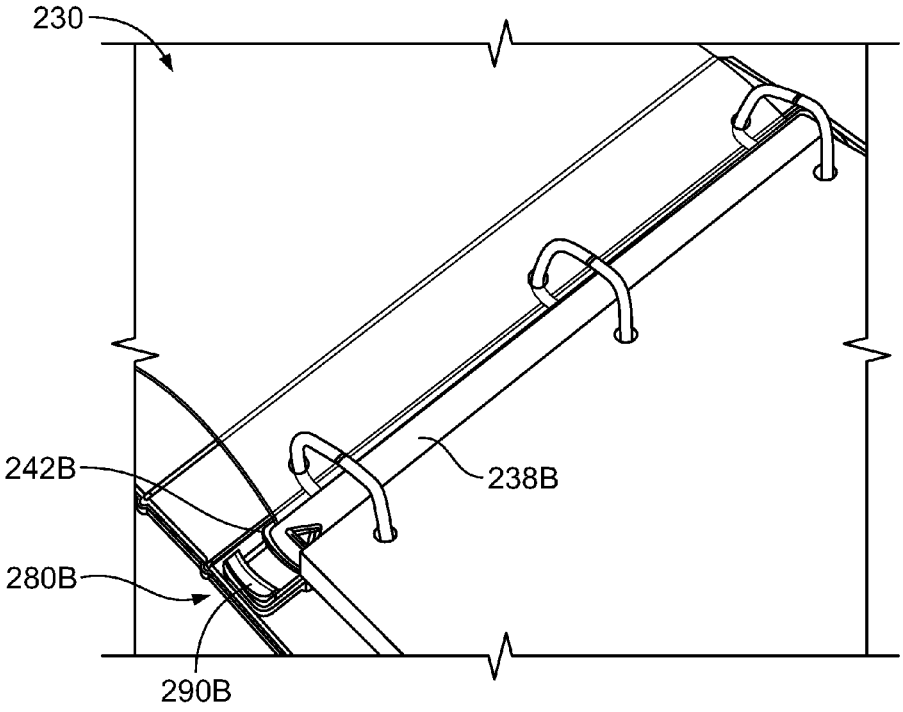
FIG. 27 is a perspective view of an embodiment of a binder mechanism coupled with a binder.
Figure 28:
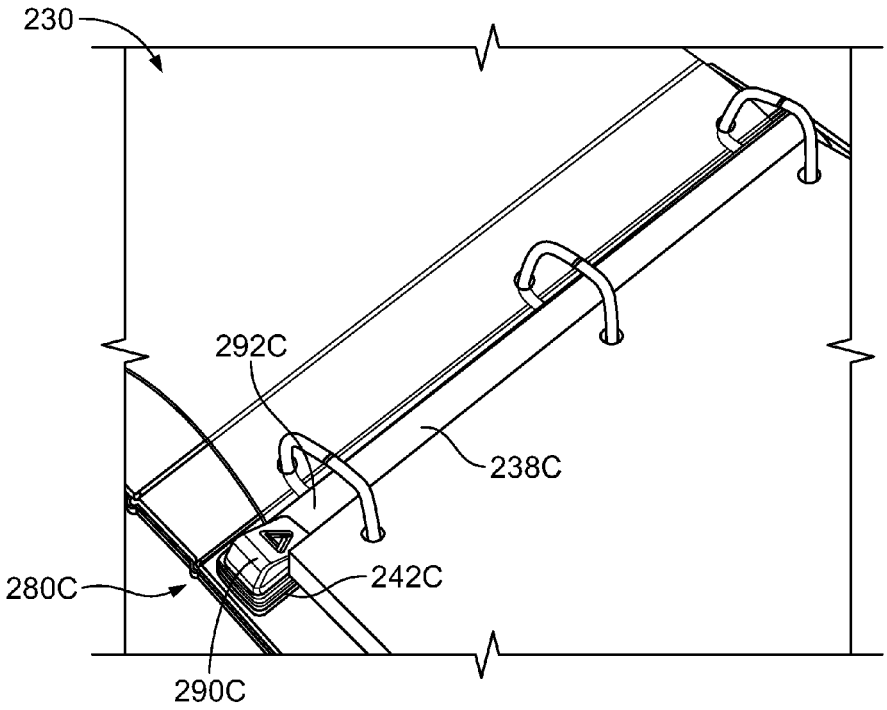
FIG. 28 is a perspective view of an embodiment of a binder mechanism coupled with a binder.

FIGS. 26-43 illustrate various embodiments of the disclosed binder and binder mechanism. In FIGS. 26, 27, and 28, disclosed is a binder 230 having various binder mechanisms 238A, 238B, and 238C that operate similar to the binder mechanisms 38 and 138 described herein and having various actuator mechanisms 280A, 280B, 280C, respectively. FIG. 26 illustrates the binder mechanism 238A in a closed position wherein the actuator mechanism 280A is configured with an actuator 290A or button that is movable by a user. In this embodiment, the actuator 290A has indicia printed thereon and includes a general triangular shape. The actuator 290A can be pushed inwardly towards the binder mechanism 238A to open the ring portions. A base 242A and a housing 292A of the binder mechanism includes a configuration that generally conforms to the shape of the actuator 290A as it is pressed inwardly thereon.

FIG. 27 illustrates the binder mechanism 238B in a closed position wherein the actuator mechanism 280B is configured with an actuator 290B or button that is movable by a user. In this embodiment, the binder mechanism 238B has indicia printed thereon and the actuator 290B includes a generally curved shaped body. The actuator 290B can be pushed inwardly towards the binder mechanism 238B to open the ring portions. A base 242B and a housing 292B of the binder mechanism 238B includes a configuration that generally conforms to the shape of the actuator 290B as it is pressed inwardly thereon.

FIG. 28 illustrates the binder mechanism 238C in a closed position wherein the actuator mechanism 280C is configured with an actuator 290C or button that is movable by a user. In this embodiment, the actuator 290C has indicia printed thereon and includes a general sloped and bulbous shape. The actuator 290C can be pulled outwardly away from the binder mechanism 238 to open the ring portions. A base 242C and a housing 292C of the binder mechanism includes a configuration that generally conforms to the shape of the actuator 290C as it is moved outwardly and inwardly thereon.

Figure 29:
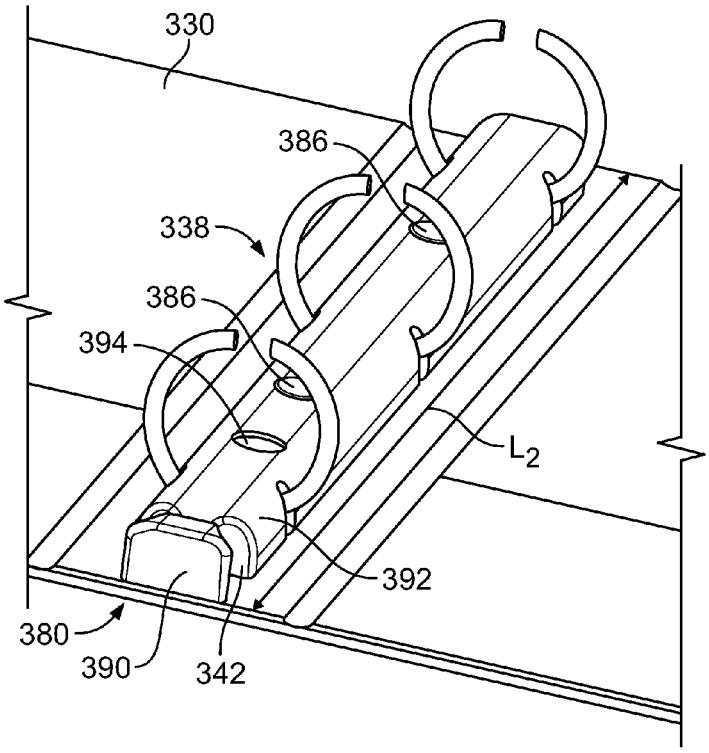
FIG. 29 is a perspective view of an embodiment of a binder mechanism coupled with a binder.

FIGS. 29 through 33 and FIGS. 34-42 illustrate another embodiment of a binder 330 and binder mechanism 338 of the present disclosure. The binder mechanism 338 is shown by FIG. 29 to include a housing 392 attached to the binder 330 by a plurality of rivets 386. In this case, there are two rivets 386 but this disclosure is not limited as to the amount as there may be one, two, three, four or any number of rivets 386. In this embodiment, the housing 392 includes a window 394 that may display various indicia to assist a user to identify if the binder mechanism 338 is in various states such as open, closed, locked or unlocked. Additionally, the binder mechanism 338 includes an actuator mechanism 380 and an actuator 390.

Figure 30:
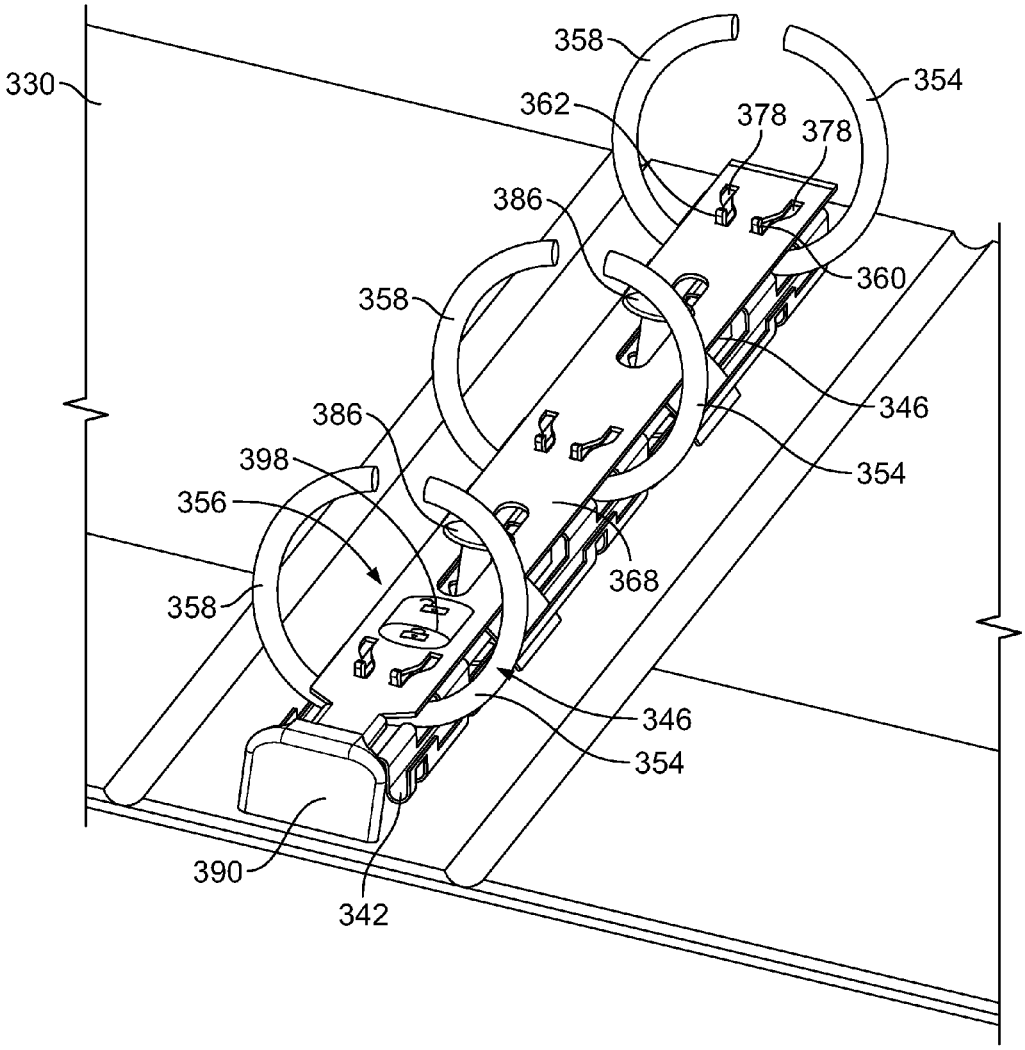
FIG. 30 is a perspective view of a portion of a binder mechanism of FIG. 29.

FIG. 30 illustrates the binder mechanism 338 having the housing 392 removed therefrom displaying the actuator mechanism 380. The actuator mechanism 380 includes a slide 364 that it is operatively engaged with a first ring base 346 and a second ring base 356. A plurality of cam profiles 378 extend laterally along the slide 364 and are positioned adjacent to a plurality of ring portions 354, 358. The cam profiles 378 receive wedge pins 360, 362 therein and the wedge pins 360, 362 extend from the first ring base 346 and second ring base 356 at a location near the ring portions 354, 358, respectively. The slide 364 is attached to the actuator 390 and a user can pull the actuator 390 outwardly or push the actuator 390 inwardly to pivot the ring portions 354, 358 between an open position and a closed position. The wedge pins 360, 362 are guided within the cam profiles 378 and pivot the first ring base 346 relative to the second ring base 356. The slide includes at least one elongated aperture to allow the rivets to remain stationary as the slide is movable. Open/closed or locked/unlocked indicia 398 are positioned along the slide 364 to be viewable through the window 394 in the housing 392.

Figure 31:
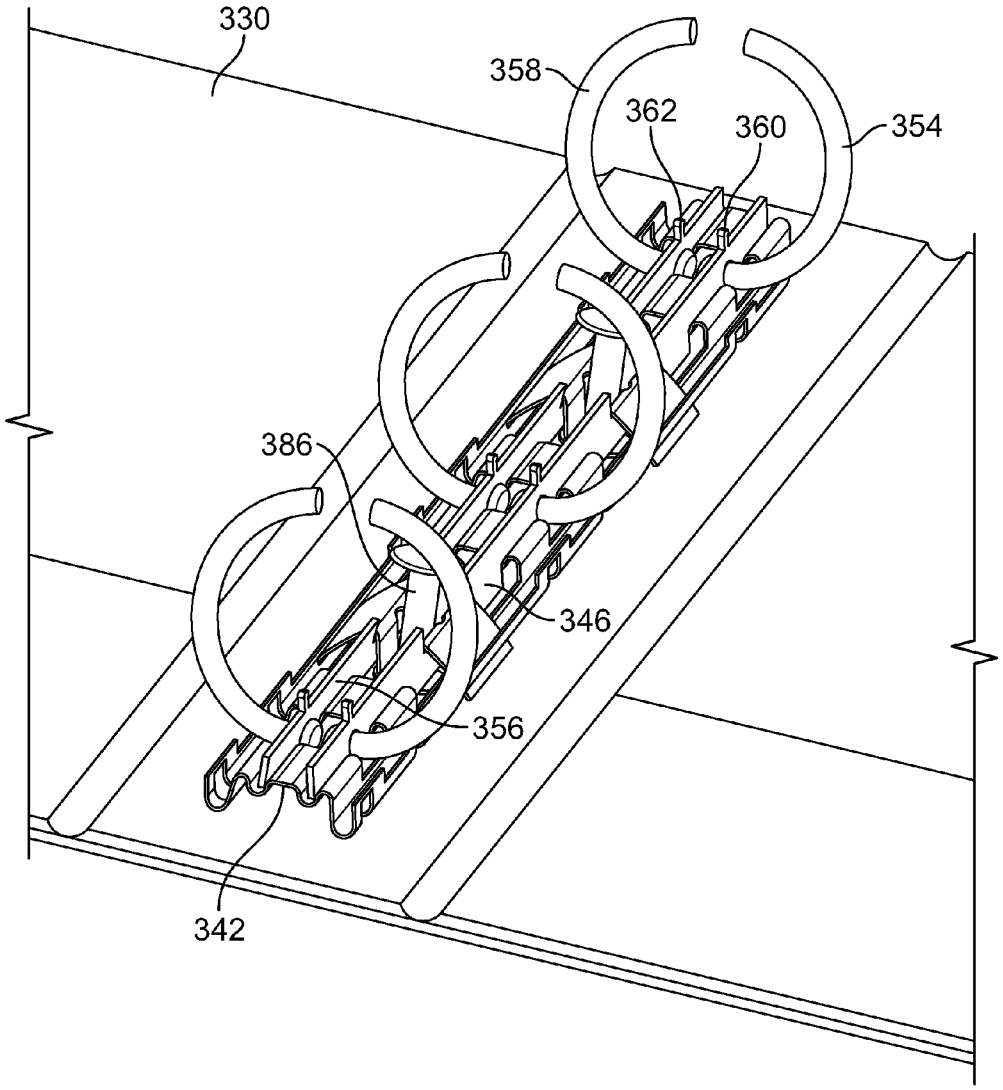
FIG. 31 is a perspective view of a portion of a binder mechanism of FIG. 29.
Figure 32:
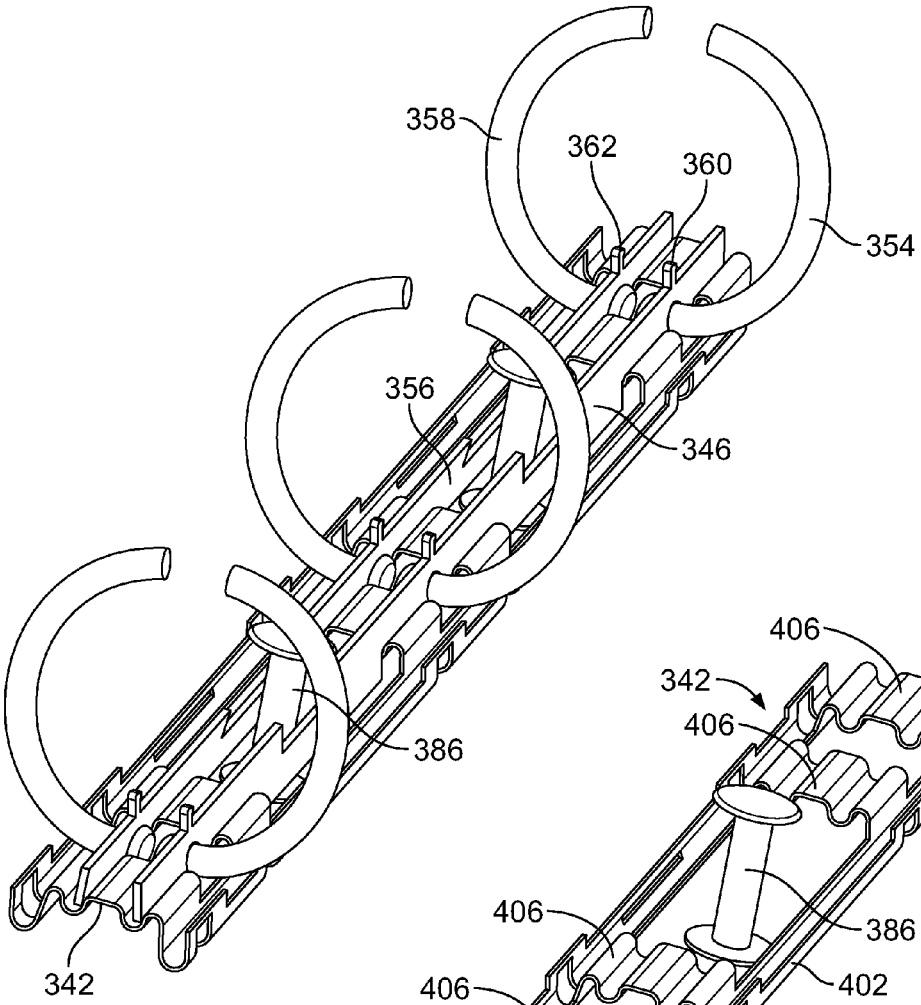
FIG. 32 is a perspective view of a portion of a binder mechanism of FIG. 29.
Figure 33:
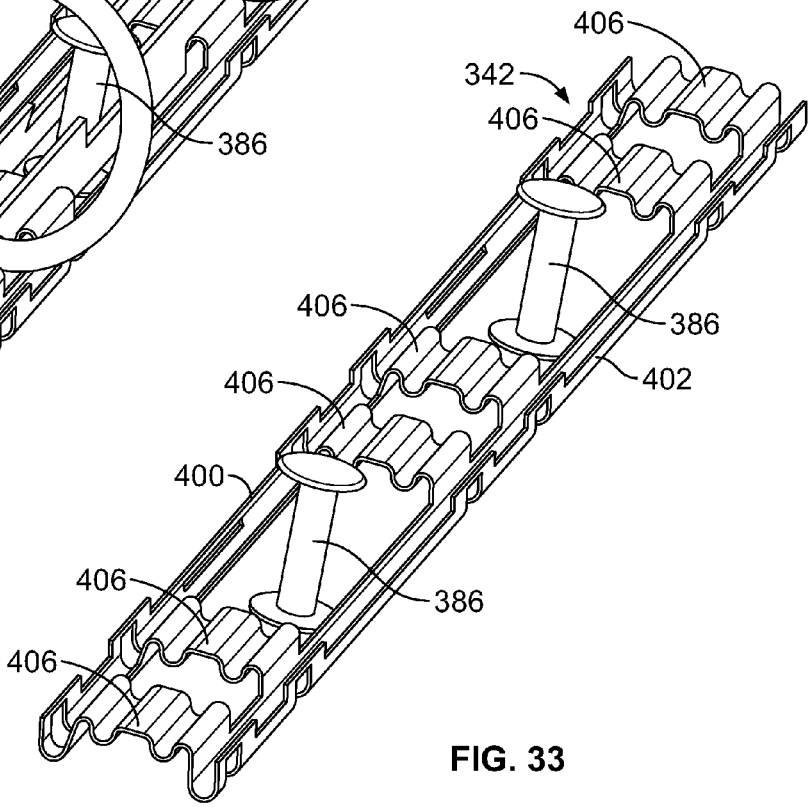
FIG. 33 is a perspective view of a portion of a binder mechanism of FIG. 24.
Figure 34:
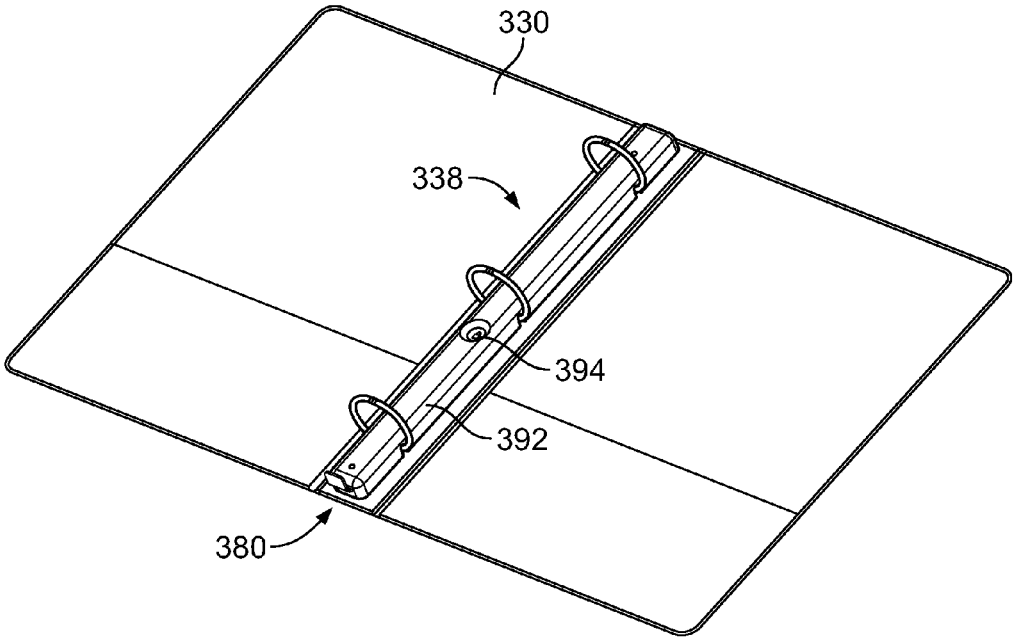
FIG. 34 is a perspective view of an embodiment of a binder mechanism coupled with a binder.
Figure 35:
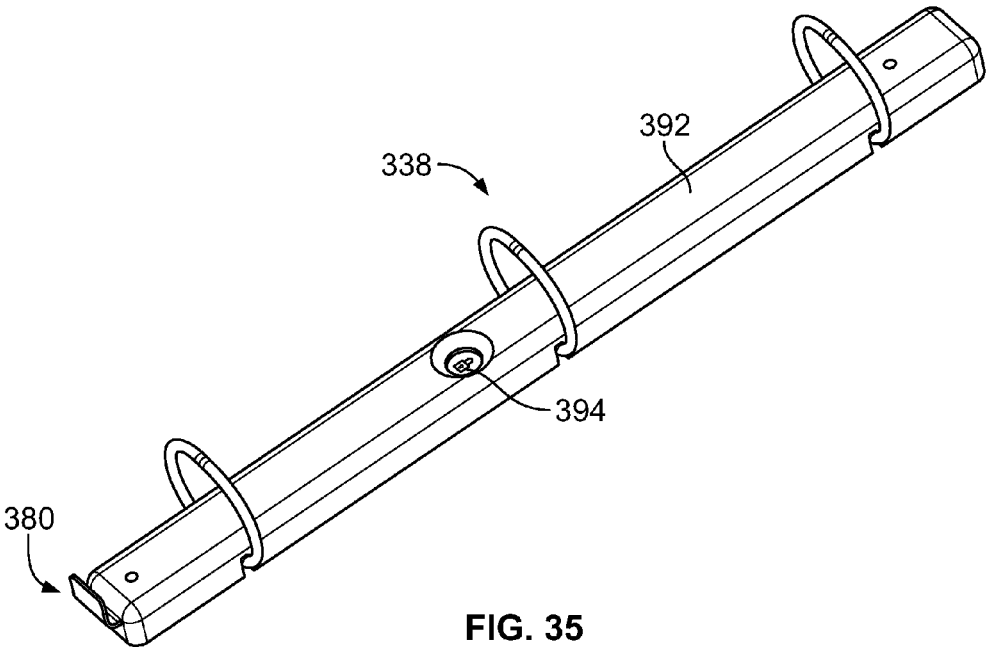
FIG. 35 is a perspective view of the binder mechanism of FIG. 34 in a closed position.
Figure 36:
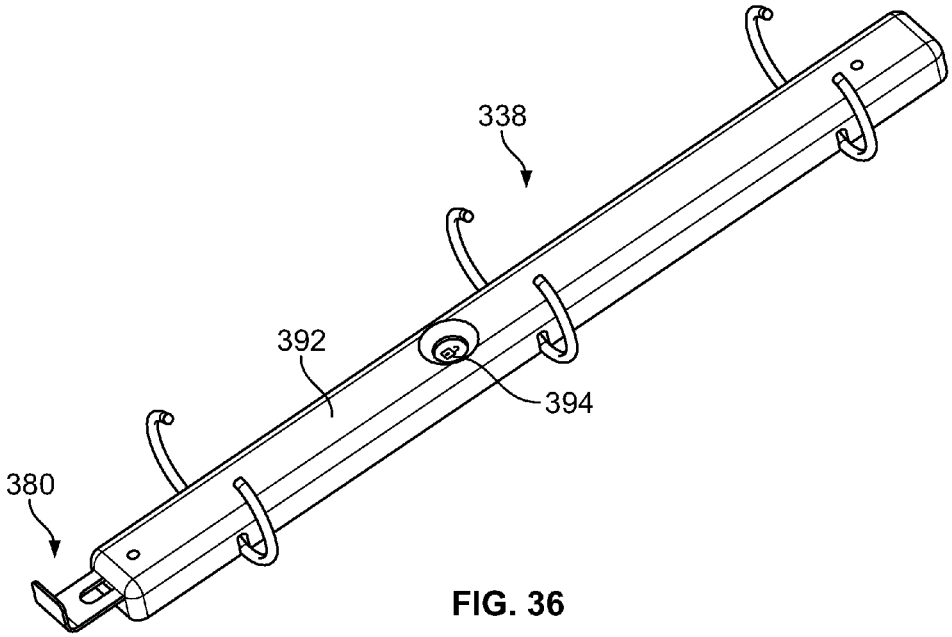
FIG. 36 is a perspective view of the binder mechanism of FIG. 34 in an open position.
Figure 37:
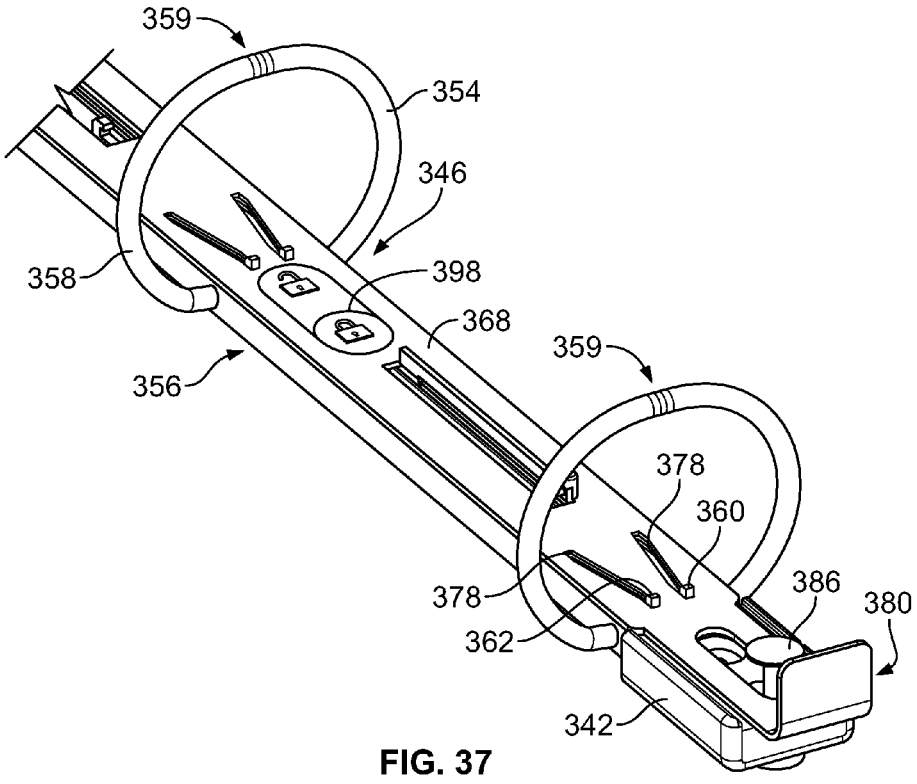
FIG. 37 is a perspective view of a portion of a binder mechanism of FIG. 34.
Figure 38:
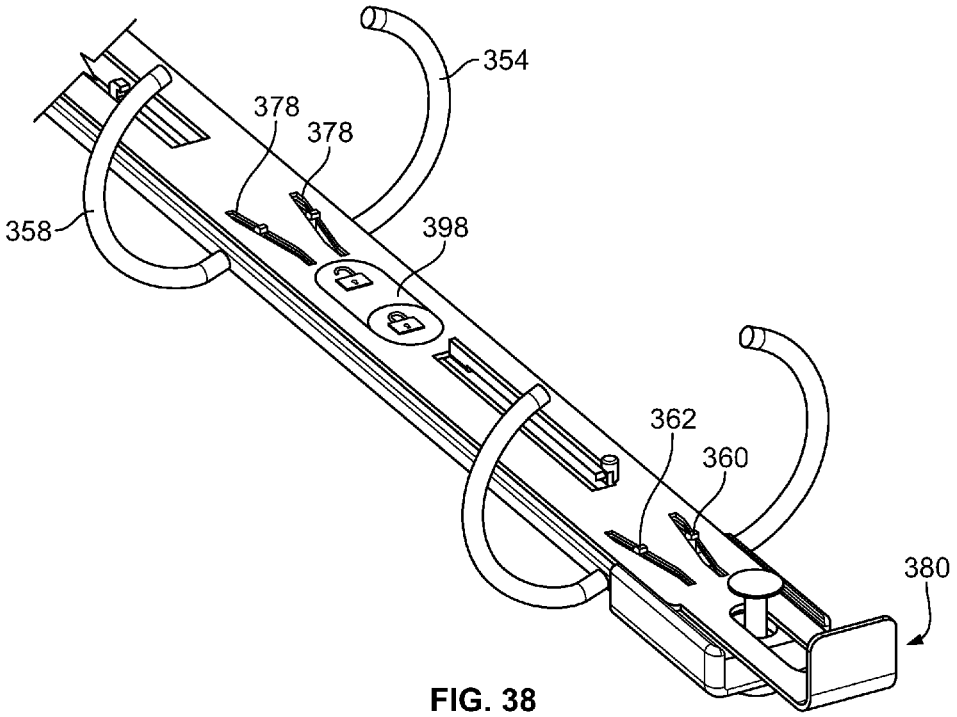
FIG. 38 is a perspective view of a portion of a binder mechanism of FIG. 34.

FIG. 31 illustrates the base 342 as it is connected to the binder 330 while FIG. 32 illustrates the base 342 without the binder. The first ring base 346 is generally aligned with the second ring base 356 along the base 342. The first ring base 346 is pivotal relative to the second ring base 356 thereon. The first ring base 346 and second ring base 356 are elongated members that include the plurality of wedge pins 360, 362 and plurality of ring portions 354, 358 that are attached thereto. FIG. 32 illustrates the base 342 and rivets 386 without the first and second ring bases 346, 356. The base 342 may include a first elongated side 400 spaced from a second elongated side 402 by a plurality of segments 406. The plurality of segments 406 may include generally serpentine configuration that allows the elongated configuration of the first ring base and second ring base 346, 356 to be positioned thereon while remaining generally pivotable related thereto. In one embodiment, there are six segments but there may be any number of segments 406 including, one, two, three, four, five, six or more.

Figure 39:
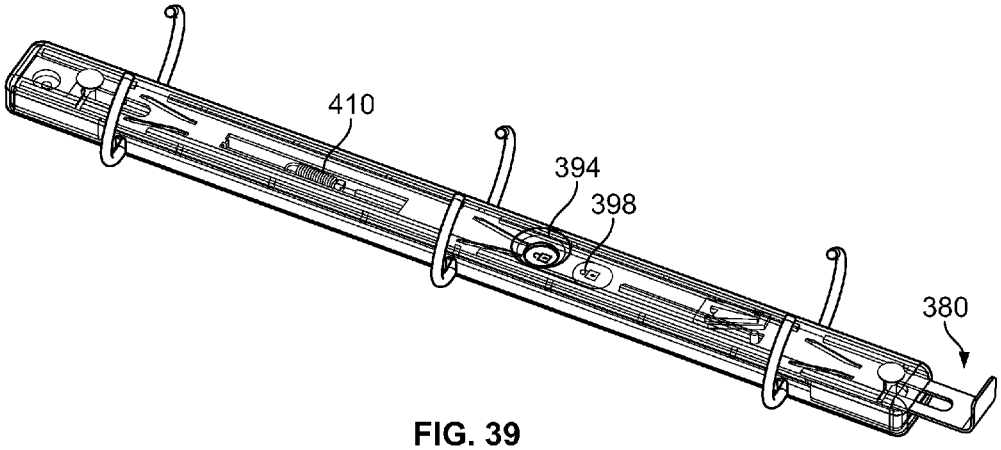
FIG. 39 is a perspective view of a portion of a binder mechanism of FIG. 34.
Figure 40:
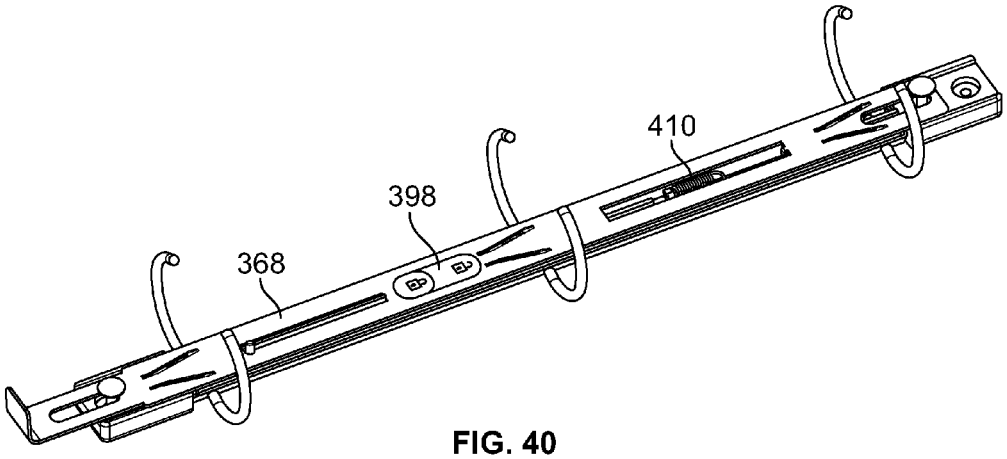
FIG. 40 is a perspective view of a portion of a binder mechanism of FIG. 34.
Figure 41:
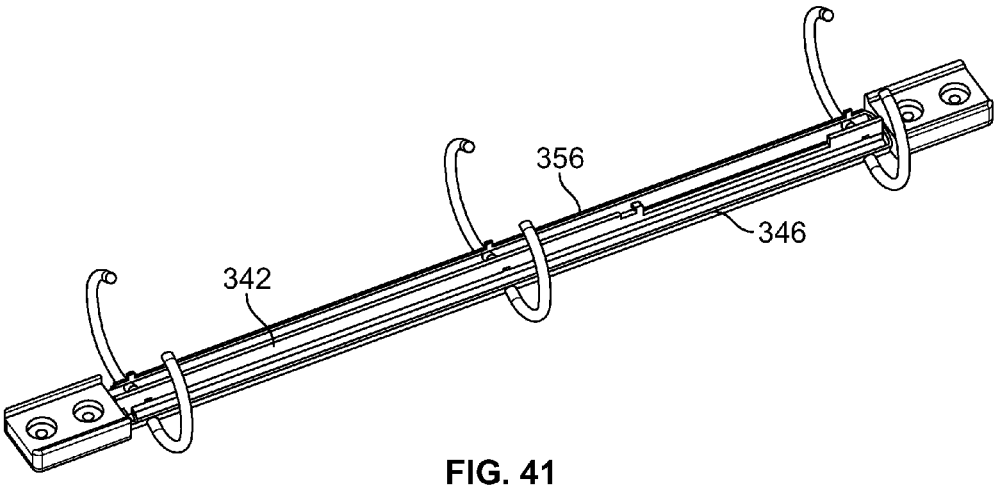
FIG. 41 is a perspective view of a portion of a binder mechanism of FIG. 34.
Figure 42:
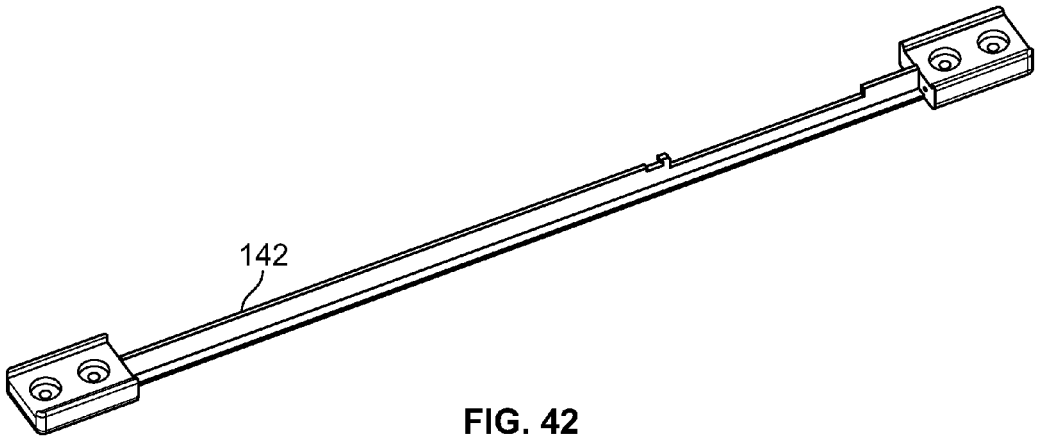
FIG. 42 is a perspective view of a portion of a binder mechanism of FIG. 34.
Figure 43:
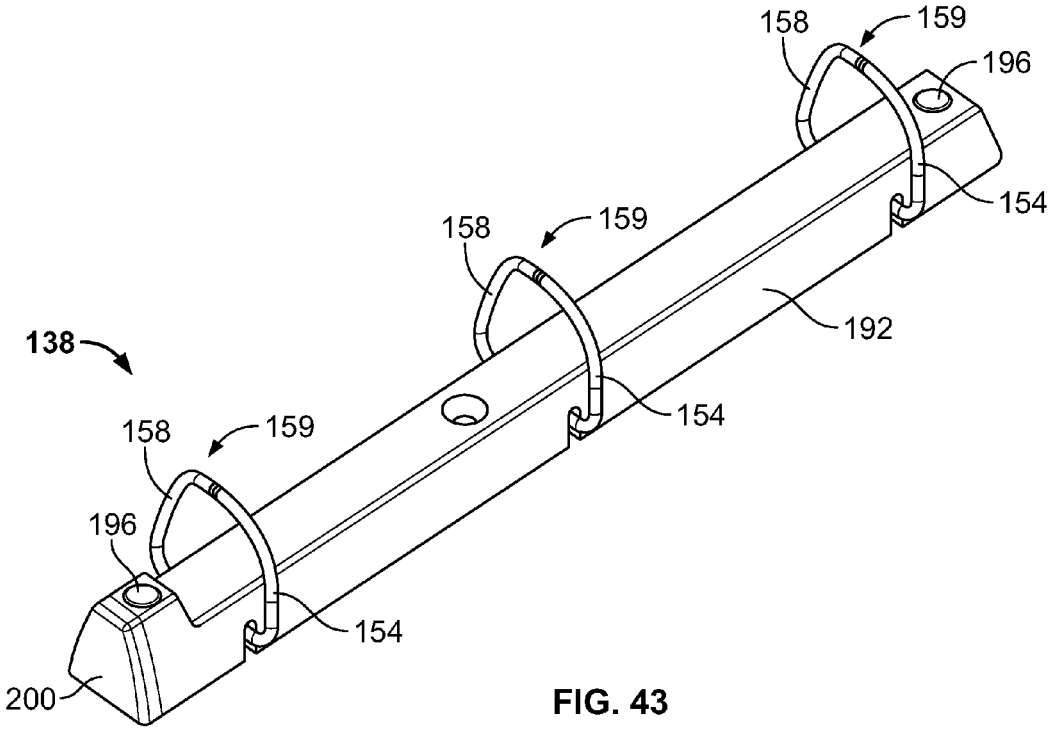
FIG. 43 is a perspective view of an embodiment of a binder mechanism.

FIGS. 34 through 42 illustrate another embodiment of a binder and binder mechanism of the present disclosure. This embodiment includes the similar features and functions of the embodiment described and illustrated by FIGS. 29-33. A biasing member 410 is attached to the actuator mechanism 380 to import a bias force thereon. The biasing member 410 is illustrated by FIGS. 39 and 40.

Although the embodiments of the present invention have been illustrated in the accompanying drawings and described in the foregoing detailed description, it is to be understood that the present invention is not to be limited to just the embodiments disclosed, but that the invention described herein is capable of numerous rearrangements, modifications and substitutions without departing from the scope of the claims hereafter. The claims as follows are intended to include all modifications and alterations insofar as they come within the scope of the claims or the equivalent thereof.

We claim:

1. A binder mechanism comprising:

a housing;

first and second ring bases positioned within the housing;

a first ring portion attached to the first ring base and a second ring portion attached to the second ring base;

a slide positioned within the housing and operatively engaged with the first and second ring bases; and an actuator positioned adjacent the housing and operatively engaged with the slide whereby the actuator selectively positions the slide to pivot the first and second ring bases with respect to each other, wherein the actuator comprises a button that is selectively pushable to position the slide to pivot the first and second ring bases with respect to each other, whereby pushing the button toward the housing positions the slide to pivot the first and second ring portions to a closed position and pushing the button toward the housing positions the slide to pivot the first and second ring portions to an open position.

2. The binder mechanism of claim 1, wherein the slide is selectively positionable relative to first ring base and the second ring base.

3. The binder mechanism of claim 1, wherein the actuator comprises a button positioned linearly adjacent to the housing.

4. The binder mechanism of claim 1, wherein the actuator comprises a button positioned away from the housing.

5. The binder mechanism of claim 1, wherein the actuator comprises a button positioned to a side of the housing.

6. The binder mechanism of claim 1, wherein the actuator is selectively pushable to position the slide to pivot the first and second ring bases with respect to each other.

7. The binder mechanism of claim 1, wherein the button is spaced from the housing when the first and second ring bases are in the open position.

8. The binder mechanism of claim 7, wherein the button is immediately adjacent the housing when the first and second ring bases are in the closed position.

9. The binder mechanism of claim 7, wherein the button is in contact with the housing when the first and second ring bases are in the closed position.

10. The binder mechanism of claim 1 further comprising a biasing member coupled to the slide to provide a bias force to bias the button outward.

11. A binder comprising:

front and rear covers;

a spine pivotally attached with at least one of the front and rear covers; and the binder mechanism attached to the spine, the binder mechanism comprising:

a housing;

first and second ring bases positioned within the housing;

a first ring portion attached to the first ring base and a second ring portion attached to the second ring base;

a slide positioned within the housing and operatively engaged with the first and second ring bases; and an actuator positioned adjacent the housing and operatively engaged with the slide whereby the actuator selectively positions the slide to pivot the first and second ring bases with respect to each other, wherein the actuator comprises a button that is selectively pushable to position the slide to pivot the first and second ring bases with respect to each other, whereby pushing the button toward the housing positions the slide to pivot the first and second ring portions to a closed position and pushing the button toward the housing positions the slide to pivot the first and second ring portions to an open position.

12. The binder mechanism of claim 11 further comprising a biasing member coupled to the slide to provide a bias force to bias the button outward.

13. A binder mechanism comprising:

a housing;

a first ring base and a second ring base positioned within the housing;

at least one first ring portion attached to the first ring base and at least one second ring portion attached to the second ring base;

a slide operatively engaged with the first and second ring bases, the slide is selectively positionable relative to first ring base and the second ring base; and an actuator operatively engaged with the slide such that the actuator is configured to selectively position the slide whereby the slide allows the first and second ring bases to pivot to position the first ring portion and the second ring portion to an open position and allows the first and second ring bases to pivot to position the first ring portion and the second ring portion to a closed position wherein the actuator is selectively laterally displaced in a direction towards the binder mechanism to position the slide to pivot the first and second ring bases with respect to each other, whereby laterally displacing the actuator toward the binder mechanism positions the slide to pivot the first and second ring portions to a closed position and laterally displacing the actuator towards the binding mechanism positions the slide to pivot the first and second ring portions to an open position.

14. The binder mechanism of claim 13 wherein the first ring portions of the first ring base are generally aligned with the second ring portions of the second ring base.

15. The binder mechanism of claim 13 wherein the binder mechanism is configured to be attached to a spine of a binder cover.

16. The binder mechanism of claim 13 wherein the first ring base includes three first ring portions and the second ring base includes three second ring portions.

17. The binder mechanism of claim 13 further comprising a pivot retainer to operatively engage with the first ring base and the second ring base.

18. The binder mechanism of claim 13 wherein at least one first pin is attached to the first ring base and at least one second pin is attached to the second ring base, the slide is operatively engaged with the first and second pins, and the actuator is configured to selectively position the slide whereby the slide positions the at least one first and second pins to pivot the first and second ring bases to position the first ring portions and the second ring portions to an open position and to pivot the first and second ring bases to position the first ring portions and the second ring positions to a closed position.

19. The binder mechanism of claim 18 wherein the slide includes at least one cam profile that operatively engages with the first and second pins.

20. The binder mechanism of claim 19 wherein the at least one cam profile extends laterally along the slide and includes a first portion and a second portion in which the first portion is angled away from the second portion laterally along the slide such that the cam profile forms a general V-shape.

21. The binder mechanism of claim 13 further comprising a biasing member coupled to the slide to provide a bias force to bias the button outward.

* * * * *